US006914584B2

(12) United States Patent
Homma et al.

(10) Patent No.: US 6,914,584 B2
(45) Date of Patent: Jul. 5, 2005

(54) PLASMA DISPLAY DEVICE WITH REDUCED POWER CONSUMPTION WHILE PREVENTING ERRONEOUS WRITE-IN

(75) Inventors: Hajime Homma, Tokyo (JP); Yoshito Tanaka, Tokyo (JP); Kota Araki, Tokyo (JP)

(73) Assignee: NEC Corporation, Tokyo (JP)

( * ) Notice: Subject to any disclaimer, the term of this patent is extended or adjusted under 35 U.S.C. 154(b) by 493 days.

(21) Appl. No.: 10/066,617

(22) Filed: Feb. 6, 2002

(65) Prior Publication Data

US 2002/0118148 A1 Aug. 29, 2002

(30) Foreign Application Priority Data

Feb. 28, 2001 (JP) ..... 2001-053805

(51) Int. Cl.[7] ..... G09G 3/28
(52) U.S. Cl. ..... 345/63; 315/169.4
(58) Field of Search ..... 345/60–72, 690; 315/169.1, 169.4

(56) References Cited

U.S. PATENT DOCUMENTS 5,745,086 A * 4/1998 Weber ..... 345/63
6,020,687 A * 2/2000 Hirakawa et al. ..... 385/135
6,037,916 A * 3/2000 Amemiya ..... 345/60
6,603,447 B1 * 8/2003 Ito et al. ..... 345/60

FOREIGN PATENT DOCUMENTS

JP 2000-305510 11/2000

* cited by examiner

*Primary Examiner*—Amr A. Awad
(74) *Attorney, Agent, or Firm*—Sughrue Mion, PLLC

(57) ABSTRACT

When a priming erasure pulse Ppre is applied, weak discharge occurs between a scanning electrode and a sustaining electrode, whereas between the scanning electrode and a data electrode, opposed discharge will not occur or, if any, may occur extremely faintly, and wall charge stuck to the scanning and sustaining electrodes, therefore, is decreased in amount to such an extent that erroneous discharge may not occur in the following address period Ta, so that the data electrode has positive-polarity wall charge left unreduced thereon or has a relatively large amount of wall charge left as stuck thereto, as a result, a sufficient level of write-in discharge can be generated even with a low value of the data voltage Vd.

15 Claims, 15 Drawing Sheets

PLASMA DISPLAY DEVICE WITH REDUCED POWER CONSUMPTION WHILE PREVENTING ERRONEOUS WRITE-IN

BACKGROUND OF THE INVENTION

1. Field of the Invention

The present invention relates to a plasma display panel driving method, a plasma display panel driving circuit, and a plasma display device utilized in a flat TV, an information display, etc. and, more particularly to, a plasma display panel driving method, a plasma display panel driving circuit, and a plasma display device that are intended to reduce a data voltage.

2. Description of the Related Art

A plasma display panel (PDP) typically has many features such as a thin construction being free of flickering and having a large display contrast, a relatively large screen, a high response speed, being self-luminous type, and multiple-color emission by use of a luminant. Recently these features of the PDP qualify itself widely for use in various fields of a computer-related display device, a color image display, etc.

Those PDPs are classified by their operating method into an AC type that an electrode is covered by a dielectric to thereby indirectly operate the panel in an AC discharged state and a DC type that the electrode is exposed to a discharge space to thereby operate the panel in a DC discharged state. The AC type PDPs are further classified by their driving method into a memory operating type that utilizes a display cell memory and a refreshing type that does not utilize it. I should be noted, the luminance of the PDPs is proportional to the number of times of discharging operations. In the case of the refreshing type PDP, its luminance decreases with an increasing display capacity, so that this type of PDP is used mainly in a small display-capacity plasma display.

As shown in FIG. 13, the display cell comprises two insulating substrates 101 and 102 which are made of glass. The insulating substrate 101 provides a rear-side substrate and the insulating substrate 102, a front-side substrate.

On such a side surface of the insulating substrate 102 that faces the insulating substrate 101 are provided a transparent scanning electrode 103 and a transparent sustaining electrode 104. The scanning electrode 103 and the sustaining electrode 104 both extend in a horizontal direction (lateral direction) of the panel. On the scanning electrode and the sustaining electrode 104 are superposed trace electrode 105 and 106 respectively. These trace electrodes 105 and 106, which are made of a metal etc., are provided to decrease the electrode resistance between the electrodes 103 and 104 and an external driving device. Further, a dielectric layer 112 is provided to cover the scanning electrode 103 and the sustaining electrode 104, while a protecting layer 114 made of magnesium oxide etc. is provided to protect this dielectric layer 112 from discharge.

On such a side surface of the insulating substrate 101 that faces the insulating substrate 102 is provided a data electrode 107 which is perpendicular to the scanning electrode 103 and the sustaining electrode 104. The data electrode 107, therefore, extends in a vertical direction of the panel. Also, a partition 109 is provided to separate the display cells from each other horizontally. Also, a dielectric layer 113 is provided to cover the data electrode 107, while a phosphor layer 111 is formed on the sides of the partition 109 and the surface of the dielectric layer 113 to convert an ultraviolet ray generated by discharge of a gas into a visible light 110. In a space between the insulating substrates 101 and 102 is reserved a discharge gas space 108 by the partition 109, which discharge gas space 108 is filled with a discharge gas consisting of Helium, Neon, or Xenon or a gas mixture thereof.

As shown in FIG. 14 shows a block diagram of a conventional AC type plasma display. The PDP 1 comprises an n number (n: natural number) of row-directional scanning electrodes 3-1 through 3-n (103) and another n number of sustaining electrodes 4-1 through 4-n (104) which alternate with each other with a predetermined spacing therebetween and an m number (m: natural number) of column-directional (perpendicular to the scanning electrode and the sustaining electrode) data electrodes 10-1 through 10-m (107). The PDP 1, therefore, has an (n×m) number of display cells.

The conventional plasma display has such a circuit for driving the PDP1 that is comprised of a driving power source 21, a controller 22, a scan driver 23, a scanning pulse driver 24, a sustaining driver 25, and a data driver 26.

The driving power source 21 generates, for example, a logic voltage Vdd of 5V, a data voltage Vd of about 70V, and a sustaining voltage Vs of about 170V and also does it generate, based on the sustaining voltage Vs, a priming voltage Vp of about 400V, a scanning base voltage Vbw of about 100V, and a bias voltage Vsw of about 180V. The logic voltage Vdd is supplied to the controller 22, the data voltage Vd is supplied to the data driver 26, the sustaining voltage Vs is supplied to the scan driver 23 and the sustaining driver 25, the priming voltage Vp and the scanning base voltage Vbw are supplied to the scan driver 23, and the bias voltage Vsw is supplied to the sustaining driver 25.

The controller 22 is a circuit for generating, based on a video signal Sv supplied from the outside, scan driver control signals Sscd1–Sscd6, scanning pulse driver control signals Sspd11–Sscd1n and Sspd21–Sspd2n, sustaining driver control signals Ssud1–Ssud3, the data driver control signals Sdd11–Sdd1m and Sdd21–Sdd2m. The scan driver control signals Sscd1–Sscd6 are supplied to the scan driver 23, the scanning pulse driver control signals Sspd11–Sspd1n and Sspd21–Sspd2n are supplied to the scanning pulse driver 24, the sustaining driver control signals Ssud1–Ssud3 are supplied to the sustaining driver 25, and the data driver control signals Sdd11–Sdd1m and Sdd21–Sdd2m are supplied to the data driver 26.

As shown in FIG. 15, the scan driver 23 is comprised of, for example, six switches 23-1 through 23-6. To one end of the switch 23-1 is applied the priming voltage Vp, and the other end thereof is connected to a positive line 27. To one end of the switch 23-2 is applied the sustaining voltage Vs, and the other end thereof is connected to positive line 27. To one end of the switch 23-3 is grounded, and the other end thereof is connected to an negative line 28. To one end of the switch 23-4 is applied the scanning base voltage Vbw, and the other end thereof is connected to the negative line 28. The switch 23-5 has its one end grounded and the other end connected to the positive line 27. The switch 23-6 has its one end grounded and the other end connected to the negative line 28. The switches 23-1 through 23-6 are turned ON/OFF by the scan driver control signals Sscd1 through Sscd6 respectively, to supply a voltage having a predetermined waveform to the scanning pulse driver 24 through the positive line 27 and the negative line 28.

As shown in FIG. 15, the scanning pulse driver 24 is comprised of, for example, an n number of switches 24-11 through 24-1n, an n number of switches 24-21 through 24-2n, an n number of diodes 24-31 through 24-3n, and an n number of diodes 24-41 through 24-4n. The diodes 24-31 through 24-3n are connected parallel between the ends of the switches 24-11 through 24-ln respectively, while the diodes 24-41 through 24-4n are connected parallel between the ends of the switches 24-21 through 24-2n respectively. Also, the switches 24-1a (a: natural number not larger than n) and the switch 24-2a are interconnected in cascade, the other ends of the switches 24-11 through 24-ln are commonly connected to the negative line 28, and the other ends of the switches 24-21 through 24-2n are commonly connected to the positive line 27. Further, an interconnection of the switches 24-1a and 24-2a is connected to a scanning electrode 3-a which is disposed at the a'th row counting from the top of the PDP1. The switches 24-11 through 24-1n and the switches 24-21 through 24-2n are turned ON/OFF by the scanning pulse driver control signals Sspd11 through Sspd1n and Sspd21 through Sspd2n to sequentially supply voltages Psc1 through Pscn of respectively predetermined waveforms to the scanning electrodes 3-1 through 3-n, respectively.

As shown in FIG. 16, the sustaining driver 25 is comprised of, for example, three switches 25-1 through 25-3. To one end of the switch 25-1 is applied the sustaining voltage Vs and to the other end thereof, connected the sustaining electrodes 4-1 through 4-n commonly. One end of the switch 25-2 is grounded and, to the other end thereof is connected the sustaining electrodes 4-1 through 4-n commonly. To one end of the switch 25-3 is applied the bias voltage vsw and to the other end thereof are connected the sustaining electrodes 4-1 through 4-n commonly (see FIG. 14). The switches 25-1 through 25-3 are turned ON/OFF by the sustaining driver control signals Ssud1 through Ssud3 to simultaneously supply a voltage Psu of a predetermined waveform to the sustaining electrodes 4-1 through 4-n.

As shown in FIG. 17, the data driver 26 is comprised of, for example, an m number of switches 26-11 through 26-1m, an m number of switches 26-21 through 26-2m, an m number of diodes 26-31 through 26-3m, and an m number of diodes 26-41 through 26-4m. The diodes 26-31 through 26-3m are connected parallel between the ends of the switches 26-21 through 26-2m respectively, while the diodes 26-41 through 26-4m are connected parallel between the ends of the switches 26-21 through 26-2m. The switches 26-1b (b: natural number not larger than m) and the switch 26-2b are connected in cascade, the other ends of the switches 26-11 through 26-1m are commonly grounded, and to the other ends of the switches 26-21 through 26-2m is supplied the data voltage Vd. Further, an interconnection of the switches 26-1b and 26-2b is connected to the data electrode 10-b which is disposed at the b'th column counting from the leftmost of the PDP 1. The switches 26-11 through 26-1m and the switches 26-21 through 26-2m are turned ON/OFF by the data driver control signals Sdd11 through Sdd1m and Sdd21 though Sdd2m to sequentially supply voltages Pd1 through Pdm of respective predetermined waveforms to the data electrodes 10-1 through 10-m, respectively.

The following will describe the write-in selection type driving operations of the conventional plasma display having the above configuration. FIG. 18 shows a timing chart of the write-in selection type driving operations of the conventional plasma display. As shown in FIG. 18, the write-in selection type driving operations employ a sub-field method, by which each sub-field is provided with four sequentially preset periods of a priming period Tp, an address period Ta, a sustaining period Ts, and a charge erasure period Te. It is hereinafter supposed that a reference voltage of the scanning and sustaining electrodes is called a sustaining voltage Vs, a higher voltage is called a positive polarity voltage, and a lower voltage is called a negative polarity voltage. Also, a reference voltage of the data electrode is called a ground potential GND, a higher voltage is called a positive polarity voltage, and a lower voltage is called a negative polarity voltage.

During the priming period Tp, first the external video signal Sv is supplied to the controller 22, which then starts to generate the scan driver control signals Sscd1–Sscd6, the sustaining driver control signals Ssud1–Ssud3, and the scanning pulse driver control signals Sspd11–Sspd1n and Sspd21–Sspd2n and also does it start to generate the data driver control signals Sdd11–Sdd1m having a level based on the video signal Sv and the data driver control signals Sdd21–Sdd2m of a low level, and then supplies these control signals to the predetermined drivers.

As a result, during the priming period Tp, the high-level scan driver control signal Sscd1 turns ON the switch 23-1, while the high-level sustaining signal Ssud2 turns ON the switch 25-2. As shown in FIG. 18, therefore, to all of the scanning electrodes 3-1 through 3-n is applied a positive-polarity priming pulse Pprp, while to all of the sustaining electrodes 4-1 through 4-n is applied a negative-polarity priming pulse Pprn. This causes priming discharge generated to occur, at every display cell, in the discharge gas space near an inter-electrode gap between the scanning electrode 103 (3-1 through 3-n) and the sustaining electrode 104 (4-1 through 4-n). With this, an active particle liable to generate write-in discharge at the display cell is generated in the discharged gas space 108, negative wall charge sticks to the scanning electrodes 3-1 through 3-n, positive wall charge sticks to the sustaining electrodes 4-1 through 4-n, and positive wall charge sticks to the data electrodes 10-1 through 10-m.

Next, the sustaining driver control signal Ssud2 falls to the LOW level to turn OFF the switch 25-2, while at the same time the sustaining driver signal Ssud1 rises to the HIGH level to turn ON the switch 25-1. Then, the scan driver control signal Sscd2 falls to turn OFF the switch 23-2, while at the same time the scan driver control signal Sscd3 rises to turn ON the switch 23-3. As a result, therefore, after all of the sustaining electrodes 4-1 through 4-n are held at the sustaining voltage Vs of about 170V, the priming erasure pulse Ppre is applied to all of the scanning electrodes 3-1 through 3-n. This causes weak discharge to occur at every display cell. This decreases the amounts of negative wall charge on the scanning electrodes 3-1 through 3-n, positive wall charge on the sustaining electrodes 4-1 through 4-n, and positive wall charge on the data electrodes 10-1 through 10-m.

Next, in the initial state of the address period Ta, the switch 25-3 is held ON by the high-level sustaining driver control signal Ssud3 and the switches 23-4 and 23-5 are also held ON by the high-level scan driver control signals Sscd4 and Sscd5 supplied in the latter half of the priming period Tp. To all of the sustaining electrodes 4-1 through 4-n is applied the positive polarity (bias voltage Vsw) bias pulse Pbp and also the pulses Psc1-Pscn applied to all the scanning electrodes 3-1 through 3-n are once held at the scanning base voltage Vbw in potential.

In such a state, the scanning pulse driver control signals Sspd11–Sspd1n fall to the LOW level sequentially and, correspondingly, the scanning pulse driver control signals Sspd21–Sspd2n rise to the HIGH level sequentially, thus turn OFF the switches 24-11 through 24-1n sequentially and also turn ON the switches 24-21 through 24-2n sequentially. Further, in synchronization therewith, although not shown, the data driver control signals Sdd11–Sdd1m rise to the HIGH level owing to the video signal Sv, matching which the data driver control signals Sdd21–Sdd2m rise to thereby cause the video signal Sv to turn ON the switches 26-11 through 26-1m and turn OFF the switches 26-21 through 26-2m. With this, when data is written to a displace cell in the a'th row in the b'th column, the negative-polarity scanning pulse Pwsn is applied to the scanning electrode 3-a, while at the same time the positive-polarity data pulse Pdb is applied to the data electrode 10-b in the b'th column. As a result, opposed discharge occurs at the display cell in the a'th row in the b'th column and also triggers off surface discharge as write-in discharge between the scanning electrode and the sustaining electrode, thus sticking wall charge to the electrodes. The display cells at which the write-in discharge did not occur remain in such a state that it has less wall charge stuck thereto after the charge is erased during the priming period Ta.

Next, in the sustaining period Ts, the scan driver control signals Sscd2 and Sscd6 alternately rise and fall repeatedly by as many times as according to their respective sub-fields. As a result, the switches 23-3 and 23-6 are alternately turned ON and OFF repeatedly. In synchronization therewith, the sustaining driver control signals Ssud1 and Ssud2 alternately rise and fall as many time as according to their respective sub-fields. As a result, the switches 25-1 and 25-2 are alternately turned ON and OFF repeatedly. Therefore, to all of the scanning electrodes 3-1 through 3-n is applied the negative-polarity sustaining pulse Psun1 as many times as according to the sub-field, while at the same time, to all of the sustaining electrodes 4-1 through 4-n is applied the negative-polarity sustaining pulse Psun2 as many times as according to the sub-field exclusively against the sustaining pulse Psun1. This causes the display cells to which no write-in operation was performed during the address period Ta to have an extremely small amount of wall charge, so that even if the sustaining pulse is applied to any one of these display cells, the sustaining discharge will not occur there. The display cell at which the write-in discharge occurred during the address period Ta, on the other hand, has positive charge stuck to its scanning electrode and negative charge stuck to its sustaining electrode, so that the sustaining pulse and the wall charge voltage are superimposed on each other to thereby raise a voltage across the electrodes in excess of a discharge start voltage, thus giving rise to discharge.

Next, during the charge erasure period Te, the scan driver control signal Sscd3 rises to thereby turn ON the switch 23-3. As a result, the negative-polarity charge erasure pulse Peen is applied to all of the scanning electrodes 3-1 through 3-n. At all of the display cells, therefore, weak discharge occurs. This causes the wall charge accumulated at the scanning electrode and the sustaining electrodes in the display cells that were emitting light during the sustaining period Ts to be erased, thus unifying the charged state of all the display cells.

In contrast to this driving method, there is available such a driving method that intends to eliminate the priming period. Hereinafter, the driving method shown in FIG. 18 is called a first prior art example and that for eliminating the priming period is called a second prior art example. FIG. 19. shows a timing chart of driving method of the second prior art.

As shown in FIG. 19, in the second prior art example, the scanning base voltage Vbw is set at a negative potential, the sustaining electrode's bias level Va and scanning base voltage Vsw during the priming period Tp are set lower in potential than the sustaining voltage Vs, the final arrival potential of the priming erasure pulse Ppre is set higher than the scanning pulse Pwsn in potential.

Also, such a driving method is proposed that reduces the potential amplitude of the data pulse by setting the potential of the sustaining electrode while the priming erasure pulse Ppre is applied to the scanning electrode higher than the potential of the sustaining electrode while the scanning pulse Pwsn is applied to the sustaining electrode (see Japan Patent Publication No. 2000-305510). Hereinafter, this driving method is called a third prior art example. FIG. 20 shows a timing chart of driving method of third prior art.

As shown in FIG. 20, in the third prior art example, like with the first prior art example, the potentials of the scanning electrode and the sustaining electrode are set not less than 0V always. Also, the bias level Va of the sustaining electrode while the priming erasure pulse Ppre is applied to the scanning electrode is set higher by 0–40V than the scanning base voltage Vsw of the sustaining electrode during the address period Ta. Correspondingly, the final arrival potential of the priming erasure pulse Ppre is set higher than the potential GND of the scanning pulse Pswn by 0–40V.

The first prior art example, however, has larger power consumption, thus suffering from a problem that it cannot meet the recent low power consumption requirement. The second prior art example, on the other hand, has the scanning electrode's potential held at a negative value during the address period Ta, thus suffering from a problem of a complicated power source construction and an insufficient decrease in power consumption. Further, the third prior art example has the potential of the sustaining electrode while the priming erasure pulse Ppre is applied to the scanning electrode set higher than the value thereof during the address period Ta, to excessively reduce the wall charge on the scanning electrode and the sustaining electrode, thus suffering from a problem of difficulty in generation of write-in discharge and deterioration in driving characteristics.

SUMMARY OF THE INVENTION

In view of the above, it is an object of the present invention to provide a plasma display panel driving method, a plasma display panel driving circuit, and a plasma display device that can reduce the power consumption while preventing erroneous write-in operations from occurring.

A plasma display panel driving method for causing such a plasma display panel to give display which corresponds to a video signal that includes first and second substrates disposed opposite to each other, a plurality of scanning electrodes and a plurality of sustaining electrodes which extend in a first direction and are alternately disposed on such a side surface of said first substrate that faces said second substrates, and a plurality of data electrodes which extends in a second direction perpendicular to said first direction and is disposed on such a side surface of said second substrate that faces said first substrate, in such a configuration that a display cell is disposed at each of intersections between said scanning and sustaining electrodes and said data electrodes, said method comprising the steps of: giving negative wall charge on said scanning electrodes and positive wall charge on said sustaining electrodes and said data electrodes; adjusting an amount of the negative wall charge on said scanning electrodes, an amount of the positive wall charge on said sustaining electrodes, and an amount of the positive wall charge on said data electrodes; setting a potential of said scanning electrodes to a positive constant value; and sequentially applying to said scanning electrodes a scanning pulse having a voltage lower than said constant value and also applying a rising data pulse to said data electrodes based on said video signal, to thereby generate write-in discharge selectively, wherein relationships of:

$$(Vd, pe)-(Vs, pe)<(Vd, w)-(Vs, w); \text{ and}$$

$$Vc1 \leqq Vc2$$

are established, where (Vs, pe) indicates a final arrival potential of said scanning electrodes in said wall-charge amount adjusting step, Vc1 indicates a potential of said sustaining electrodes, (Vd, pe) indicates a potential of said data electrodes, (Vs, w) indicates a potential of said scanning pulse, (Vd, w) indicates a potential of said data electrode in the display cell to which said data pulse is not applied even when said scanning pulse is applied on the basis of said video signal, and Vc2 indicates a potential of said sustaining electrodes in said step of applying said scanning pulse and said data pulse.

Moreover, a plasma display panel driving circuit for causing such a plasma display panel to give display which corresponds to a video signal that includes first and second substrates disposed opposite to each other, a plurality of scanning electrodes and a plurality of sustaining electrodes which extend in a first direction and are alternately disposed on such a side surface of said first substrate that faces said second substrates, and a plurality of data electrodes which extends in a second direction perpendicular to said first direction and is disposed on such a side surface of said second substrate that faces said first substrate, in such a configuration that a display cell is disposed at each of intersections between said scanning and sustaining electrodes and said data electrodes, said circuit comprising a controller for: giving negative wall charge on said scanning electrodes and positive wall charge on said sustaining electrodes and said data electrodes; adjusting an amount of the negative wall charge on said scanning electrodes, an amount of the positive wall charge on said sustaining electrodes, and an amount of the positive wall charge on said data electrodes; setting a potential of said scanning electrodes to a positive constant value; and sequentially applying to said scanning electrodes a scanning pulse having a voltage lower than said constant value and also applying a rising data pulse to said data electrodes based on said video signal, to thereby generate write-in discharge selectively, wherein relationships of:

$$(Vd, pe)-(Vs, pe)<(Vd, w)-(Vs, w); \text{ and}$$

$$Vc1 \leqq Vc2$$

are established, where (Vs, pe) indicates a final arrival potential of said scanning electrodes in said wall-charge amount adjusting step, Vc1 indicates a potential of said sustaining electrodes, (Vd, pe) indicates a potential of said data electrodes, (Vs, w) indicates a potential of said scanning pulse, (Vd, w) indicates a potential of said data electrode in the display cell to which said data pulse is not applied even when said scanning pulse is applied on the basis of said video signal, and Vc2 indicates a potential of said sustaining electrodes in said step of applying said scanning pulse and said data pulse.

By the present invention, as for an opposed potential difference between a potential of the scanning electrode and that of the opposed electrode, a potential difference ( (Vd, pe)−(Vs, pe) ) at the time of priming erasure is set smaller than a potential difference ((Vd, w)−(Vs, w)) at the time of write-in, so that the opposed discharge does not occur at all or may occur extremely faintly. Therefore, positive wall charge given to the data electrode previously is decreased little to thereby improve an internal voltage at the time of the following write-in operation. With this, the write-in operation can be performed securely even with a decreased potential of the data pulse applied to the data electrode, thus reducing the power consumption. Also, as for the potential of the sustaining electrode, a potential Vc1 employed at the time of priming erasure is set not larger than a potential Vc2 employed at the time of write-in, thus suppressing the occurrence of erroneous lighting due to erroneous write-in.

After the above write-in discharge is generated, a sustaining pulse with a potential of Vs can be applied to the scanning electrode and the sustaining electrode alternately to thereby establish a relationship of $Vs \leqq Vc2-(Vs, w) < Vs+40(V)$ , thus reserving a secures driving margin. When a relationship of $Vs+15 \leqq Vc2-(Vs, w) < Vs+25(V)$ is established, in particular, a large driving margin can be reserved.

Also, a relationship of (Vs, pe)>(Vs, w) may be established, in which case further a relationship of Vc1−(Vs, pe)<Vc2−(Vs, w) can be established.

Further, a relationship of (Vd, pe)<(Vd, w) may be established, in which case further a relationship of Vc1−(Vs, pe)≦Vc2−(Vs, w) and/or a relationship of Vc1−(Vs, pe)≧Vs can be established.

The plasma display device of the present invention features either one of the above driving circuit and a plasma display panel driven by this driving circuit.

DESCRIPTION OF THE PREFERRED EMBODIMENTS

To solve the above problems, the inventor et al. carried out experiments and researches greatly and found that by establishing a relationship of ( (Vd, pe)−(Vs, pe))<((Vd, w)−(Vs, w) (where (Vs, pe) indicates a final arrival potential of the scanning electrode when decreasing wall charge during the priming period, (Vd, pe) indicates a potential of the data electrode, (Vs, w) indicates a potential of the scanning pulse, and (Vd, w) indicates a potential of the data electrode of a display cell to which the data pulse is not applied even when the scanning pulse is applied on the basis of the video signal), the data voltage required to generate write-in discharge can be reduced, thus resulting in an decrease in power consumption. Although this relationship is established also in a second prior art example, the above-mentioned problem cannot be solved because the scanning base voltage is negative. Even when the scanning base voltage is just turned positive to solve this problem like in the case of a third prior art example, in the second prior art example, a potential difference between the scanning electrode and the sustaining electrode when the priming erasure pulse Ppre has reached the final arrival potential is an extremely large value of about 238V and a potential difference between the scanning pulse Pwsn and the bias voltage during the address period is also an extremely large value of 247V, so that normal operations cannot be expected.

First Embodiment

Figure 1:
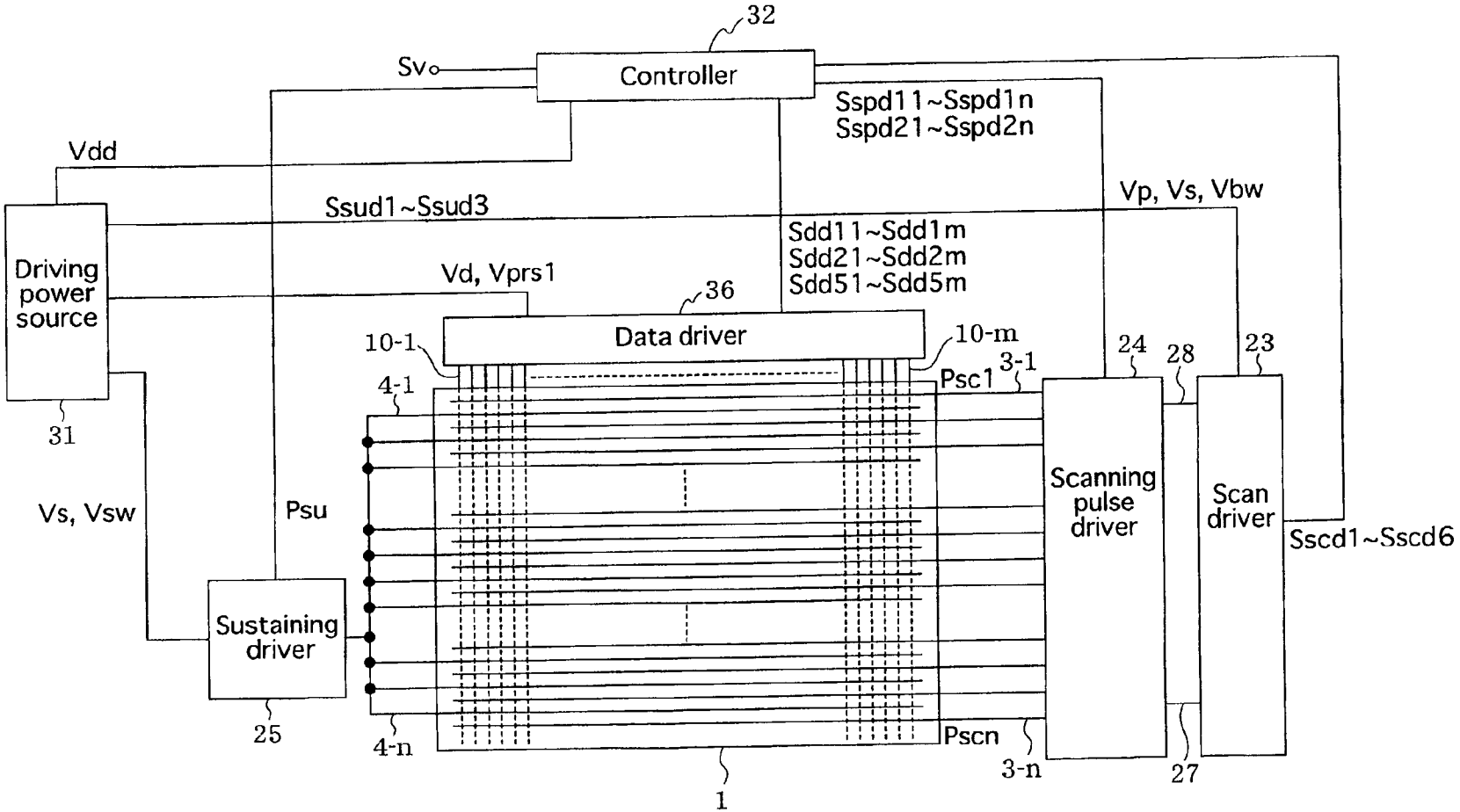
FIG. 1 is a block diagram for showing a construction of a plasma display panel according to an embodiment of the present invention.

The following will specifically describe a plasma display according to a first embodiment of the present invention with reference to accompanying drawings. FIG. 1 is a block diagram showing a configuration of plasma display according to first embodiment of the present invention.

Figure 14:
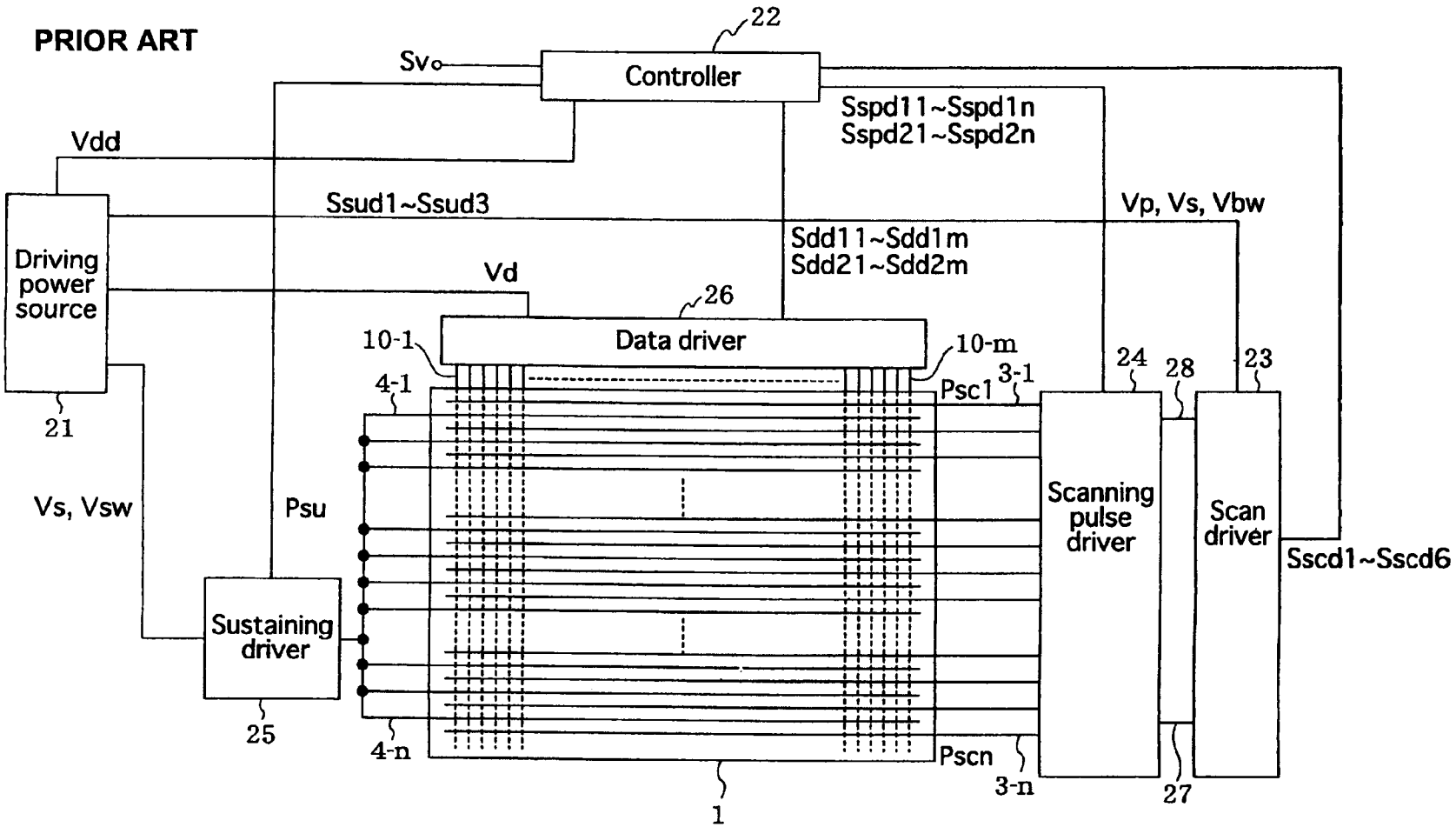
FIG. 14 PRIOR ART
FIG. 14 is a block diagram for showing a prior art AC-type plasma display.
Figure 15:
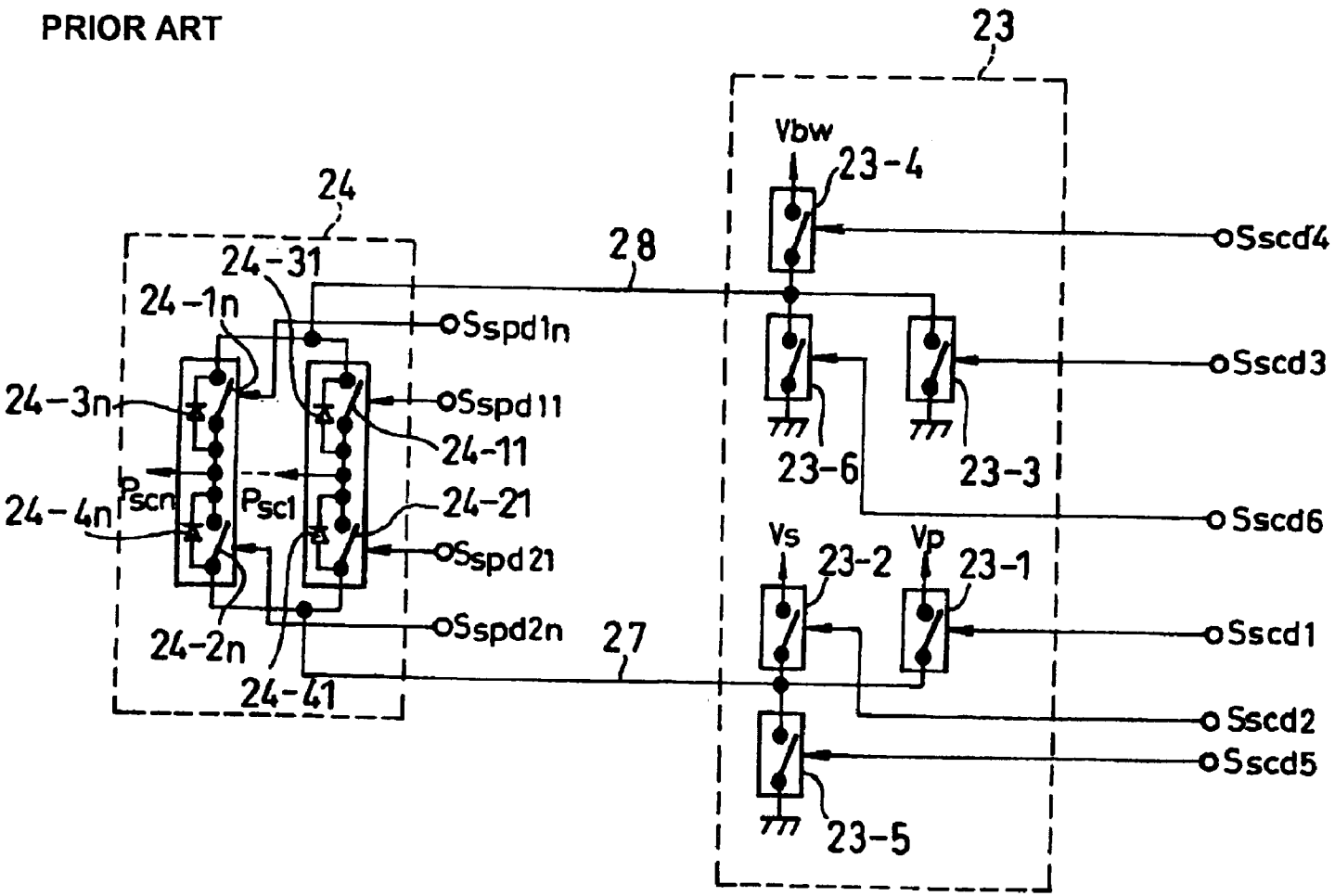
FIG. 15 PRIOR ART
FIG. 15 is a circuit diagram for showing a construction of a scan driver 23 and a scanning pulse driver 24.
Figure 16:
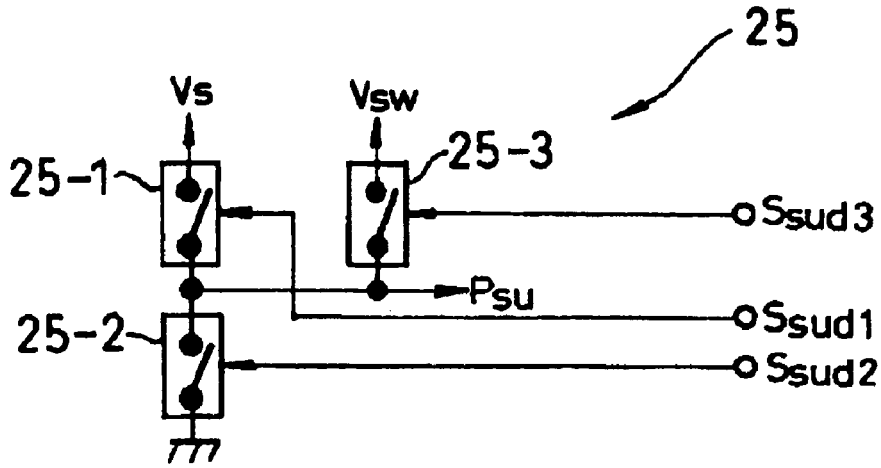
FIG.16 PRIOR ART
FIG. 16 is a circuit diagram for showing a construction of a sustaining driver 25.
Figure 17:
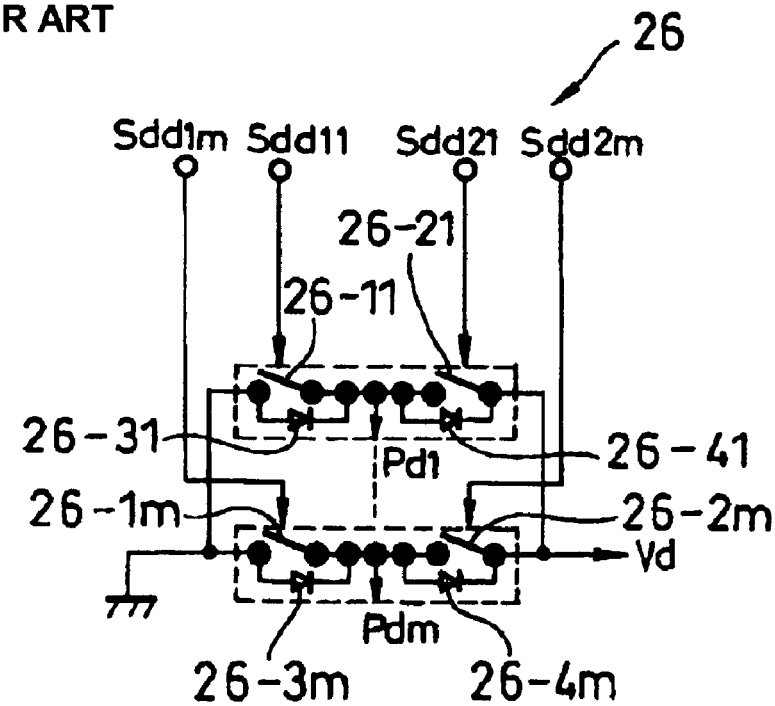
FIG.17 PRIOR ART
FIG. 17 is a circuit diagram for showing a construction of a data driver 26.

The first embodiment is different from a first prior art example shown in FIG. 14 in that a driving power source 31 is substituted for a driving power source 21, a controller 32 is substituted for a controller 22, and a data driver 36 is substituted for a data driver 26.

The driving power source 31 is configured to generate the opposed-discharge preventing voltage Vprs1 of about ?10V besides, for example, the logic voltage Vdd of 5V, the data voltage Vd of about 55V, the sustaining voltage Vs of about 170V, the priming voltage Vp of about 400V, the scanning base voltage Vbw of about 100V, and the bias voltage Vsw of about 180V. The opposed-discharge preventing voltage Vprs1 is supplied to the data driver 36.

The controller 32 consists of a circuit for generating the data driver control signals Sdd51–Sdd5m besides the scan driver control signals Sscd1–Sscd6, the scanning pulse driver control signals Sspd11–Sspd1n and Sspd21–Sspd2n, the sustaining driver control signals Ssud1–Ssud3, and the data driver control signals Sdd11–Sdd1m and Sdd21–Sdd2m.

Figure 2:
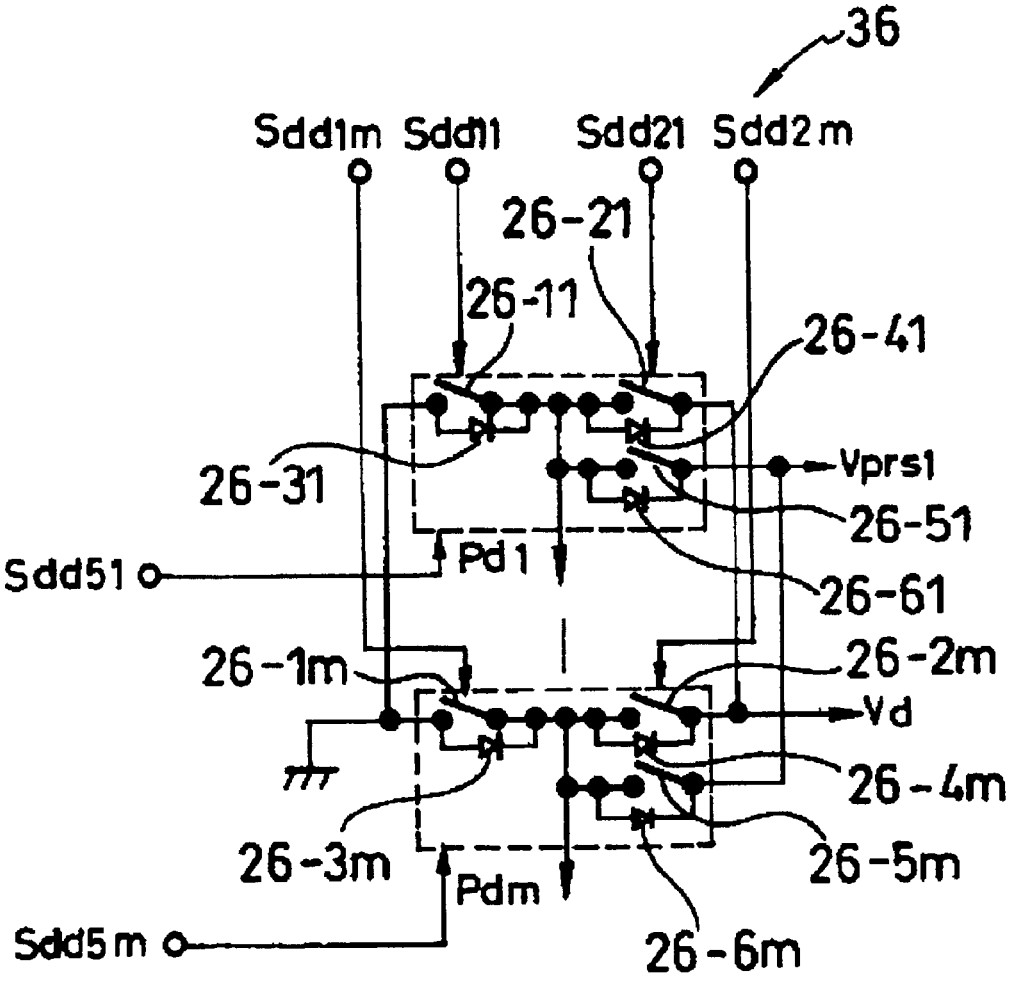
FIG. 2 is a circuit diagram for showing a construction of a data driver 36.

As shown in FIG. 2, the data driver 36 comprises, for example, an m number of switches 26-11 through 26-1m, an m number of switches 26-21 through 26-2m, an m number of switches 26-51 through 26-5m, an m number of diodes 26-31 through 26-3m, an m number of diodes 26-41 through 26-4m, and an m number of diodes 26-61 through 26-6m. The diodes 26-61 through 26-6m are connected parallel between the both ends of the switches 26-51 through 26-5m respectively. One end of the switch 26-5b is connected to an interconnection of the switches 26-1b and 26-2b and, to the other end thereof is supplied the opposed-discharge preventing voltage Vprs1. The switches 26-51 through 26-5m are turned ON/OFF by the data driver control signals Sdd51–Sdd5m respectively, to sequentially supply Voltages Pd1-Pdm of predetermined waveforms to the data electrodes 10-1 through 10-m respectively.

The driving circuit comprises the driving power source 31, the controller 32, and the drivers 23, 24, 25, and 36.

Figure 3:
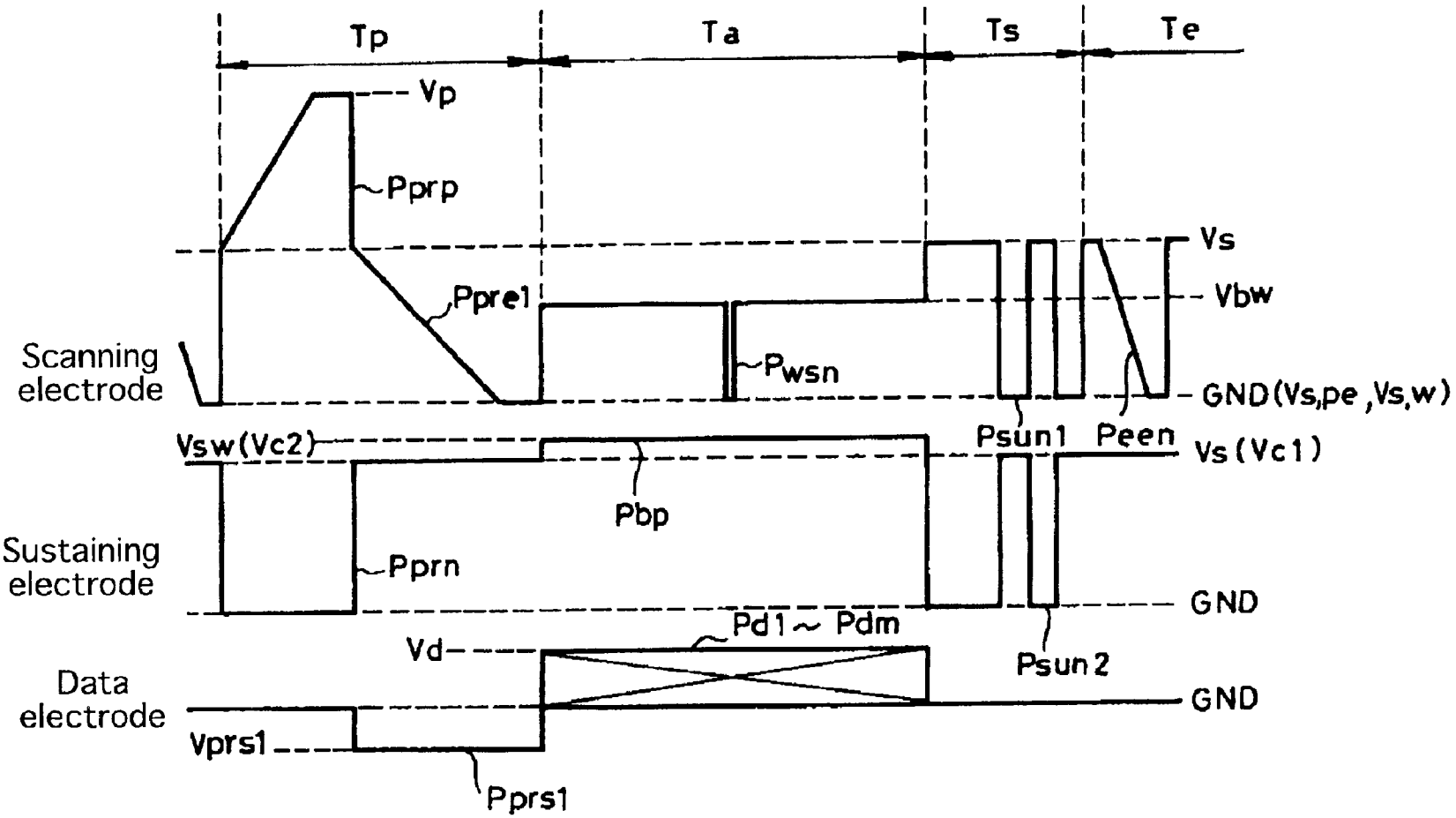
FIG. 3 is a timing chart for showing operations of a plasma display according to a first embodiment of the present invention.
Figure 4:
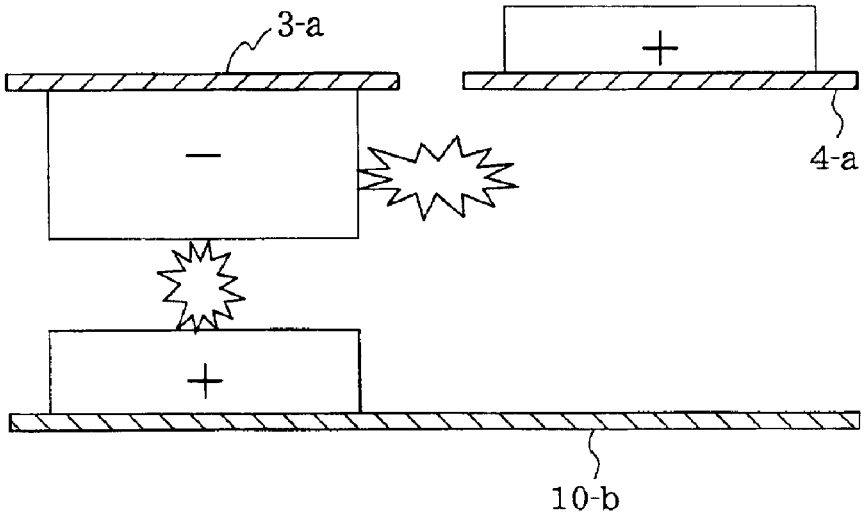
FIG. 4 is a schematic diagram for showing a charged state when priming pulses Pprp and Pprn are applied.
Figure 5:
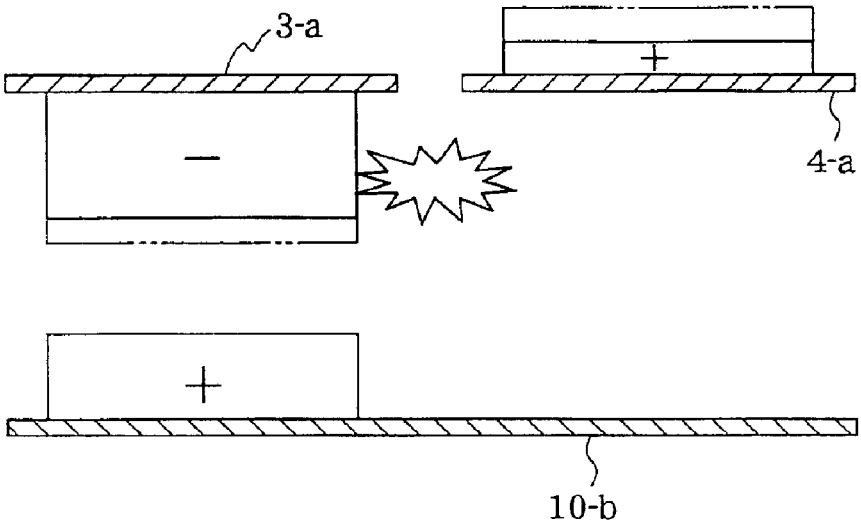
FIG. 5 is a schematic diagram for showing a subsequent charged state when a priming erasure pulse Ppre1 was applied in the first embodiment and, as a result, opposed discharge did not occur.
Figure 6:
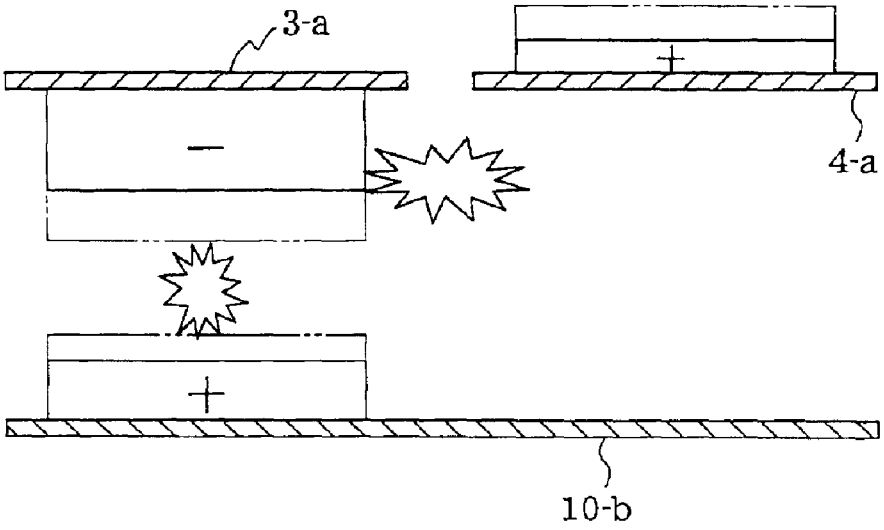
FIG. 6 is a schematic diagram for showing a subsequent charged state when the priming erasure pulse Ppre1 was applied in the first embodiment and, as a result, opposed discharge occurred.
Figure 7:
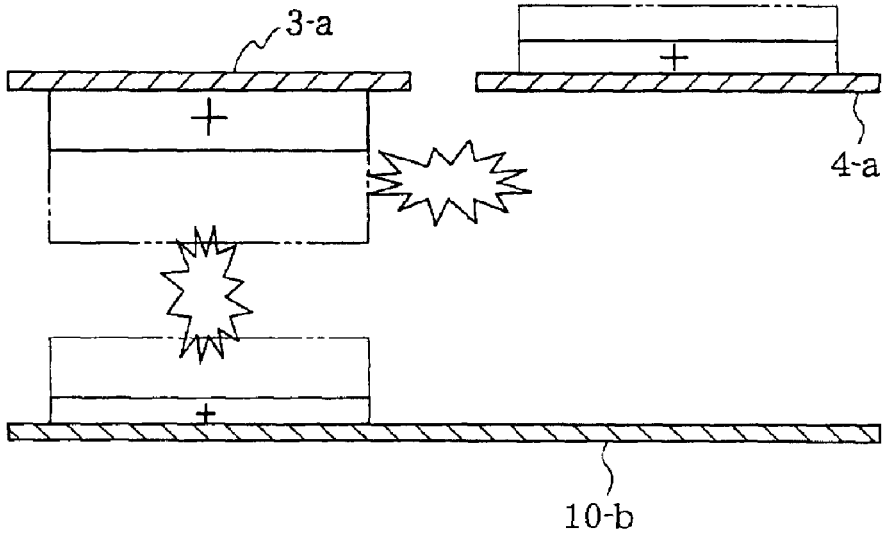
FIG. 7 is a schematic diagram for showing a subsequent charged state when a priming erasure pulse Ppre was applied in a prior art plasma display and, as a result, opposed discharge occurred.
Figure 18:
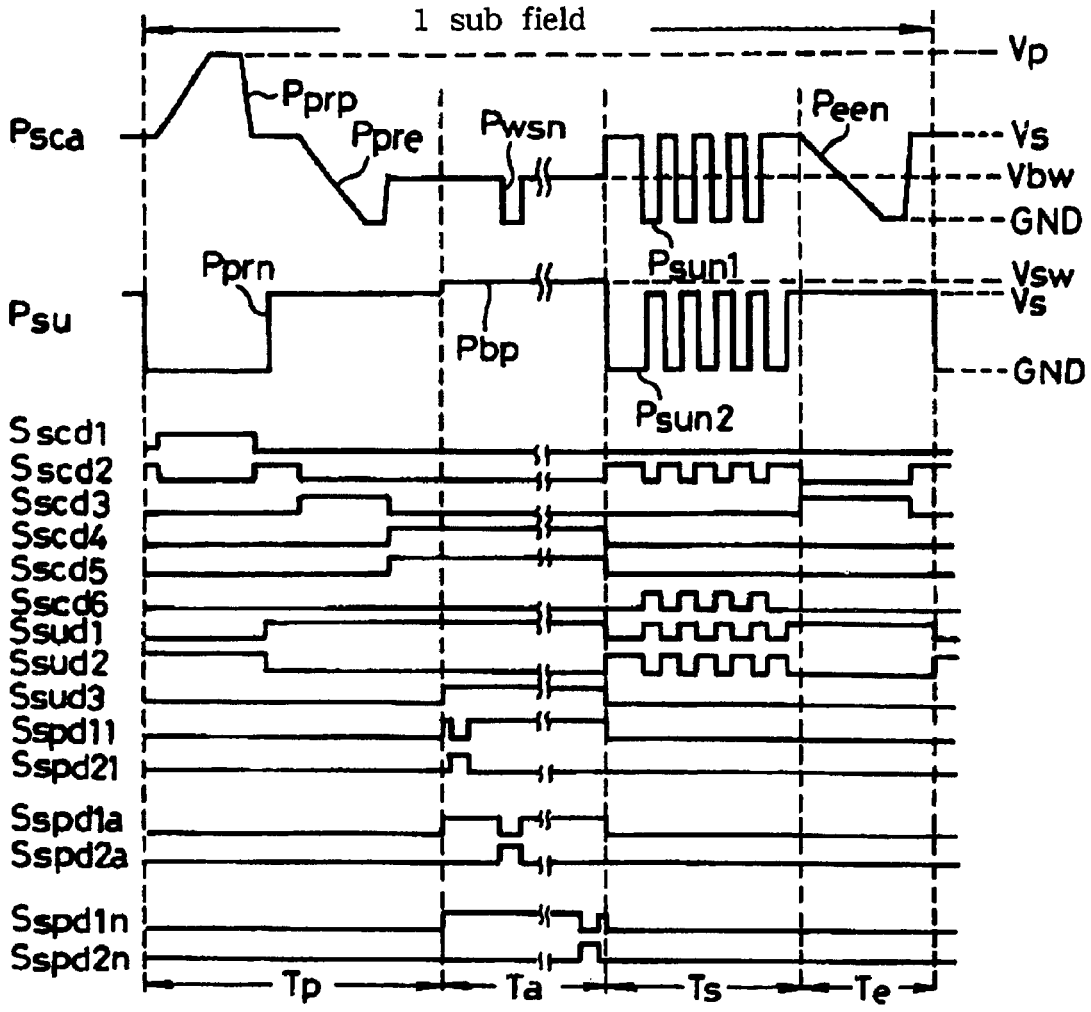
FIG.18 PRIOR ART
FIG. 18 is a timing chart for showing write-in selection type driving operations (first prior art) of the prior art plasma display.
Figure 19:
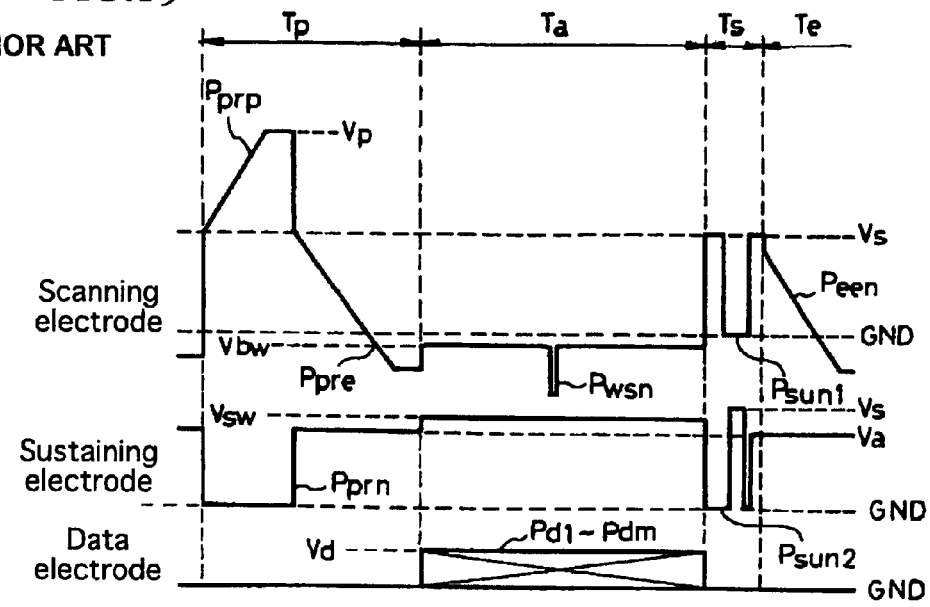
FIG.19 PRIOR ART
FIG. 19 is a timing chart for showing a driving method according to a second prior art example.
Figure 20:
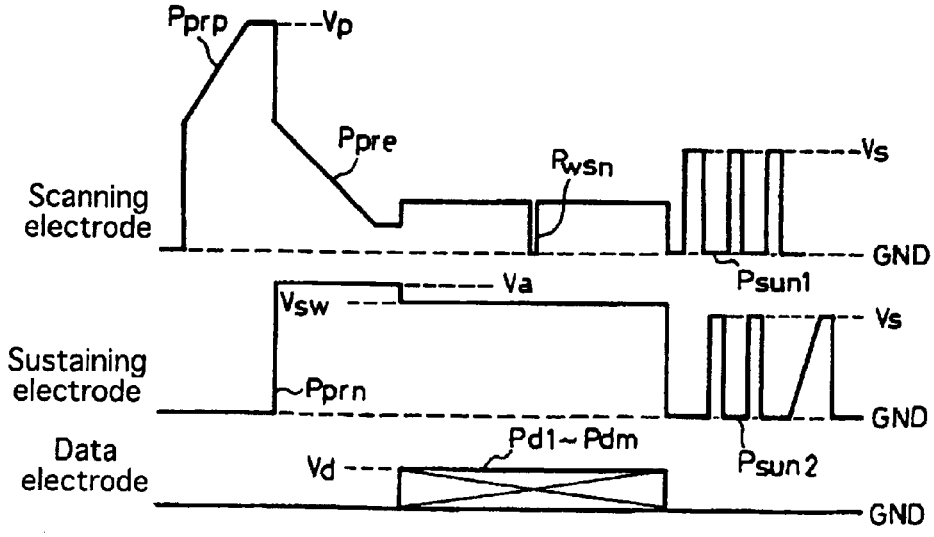
FIG.20 PRIOR ART
FIG. 20 is a timing chart for showing the driving method according to a third prior art example.

The following will describe the operations of a plasma display according to the first embodiment having the above-mentioned configuration. FIG. 3 is a timing chart for showing operations of a plasma display according to a first embodiment of the present invention; FIG. 4 is a schematic diagram for showing a charged state when priming pulses Pprp and Pprn are applied; FIG. 5 is a schematic diagram for showing a subsequent charged state when a priming erasure pulse Ppre1 was applied in the first embodiment and, as a result, opposed discharge did not occur; FIG. 6 is a schematic diagram for showing a subsequent charged state when the priming erasure pulse Ppre1 was applied in the first embodiment and, as a result, opposed discharge occurred; and FIG. 7 is a schematic diagram for showing a subsequent charged state when a priming erasure pulse Ppre was applied in a prior art plasma display and, as a result, opposed discharge occurred;

As shown in FIG. 3, by this embodiment, like in the case of a prior art driving method shown in FIG. 18, during the priming period Tp, the positive-polarity priming pulse Pprp is applied to the scanning electrodes 3-1 through 3-n and also the negative-polarity priming pulse Pprn is applied to the sustaining electrodes 4-1 through 4-n, with the potentials of the data electrodes 10-1 through 10-m as held at the ground potential GND. As a result, as shown in FIG. 4, surface discharge occurs between the scanning electrodes 3-1 through 3-n and the sustaining electrodes 4-1 through 4-n, while opposed discharge occurs between the scanning electrodes 3-1 through 3-n and the data electrodes 10-1 through 10-m, so that resultantly an active particle is generated in the discharge gas space and also negative wall charge sticks to every scanning electrode and positive wall charge sticks to all of the data electrodes and the sustaining electrodes.

Next, the priming erasure pulse Ppre1 is applied to all of the scanning electrodes 3-1 through 3-n and also the controller 32 outputs the high-level data driver control signals Sdd51–Sdd5m to the data driver 36, to turn ON the switches 26-51 through 26-5m. By the data driver 36, therefore, the negative-polarity (opposed-discharge preventing voltage Vprs1) opposed discharge preventing pulse Pprs1 is applied to each of the data electrodes 10-1 through 10-m. During this step, the potentials of the sustaining electrodes 4-1 through 4-n are held at the sustaining voltage Vs (Vc1). As described above, since the opposed-discharge preventing voltage Vprs1 has a value of −10V, a difference Dvpe1 is given by the following Equation 1 between a potential of the scanning electrode and a potential of the data electrode (Vprs1=Vd, pe) when the priming erasure pulse Ppre1 has reached the ground potential GND, the final arrival potential Vs, pe:

$$Dvpe1=(Vd,\ pe)-(Vs,\ pe)=(-10)-0=-10\ (V) \qquad \text{[Equation 1]}$$

Also, a difference between the final arrival potential Vs, pe (0V) and a potential of the sustaining electrode (sustaining voltage Vs: 170V) is equal to the sustaining voltage Vs (170V).

Like in the case of the prior art driving method, therefore, between the scanning electrode and the sustaining electrode occurs weak discharge which is opposite in polarity to that at the time of application of the priming pulses Pprp and Pprn, while between the scanning electrode and the data electrode, on the other hand, as shown in FIG. 5, opposed discharge will not occur or, as shown in FIG. 6, may occur very faintly. By the prior art driving method, on the other hand, the data electrode has its potential held at the ground level GND, so that as shown in FIG. 7, opposed discharge occurred readily. In this embodiment, therefore, as shown in FIG. 5 or 6, the wall charge stuck to the scanning electrodes 3-1 through 3-n and the sustaining electrodes 4-1 through 4-n is reduced in amount to such a level that erroneous discharge may not occur during the subsequent address period Ta, so that the data electrodes 10-1 through 10-m have the positive charge thereon as unreduced or a relatively large amount of wall charge as left stuck thereto.

During the address period Ta following the priming period Tp, like in the case by the prior art driving method shown in FIG. 18, the display cells are scanned in such state that the positive-polarity (bias voltage Vsw: Vc2) bias pulse Pbp is applied to all of the sustaining electrodes 4-1 through 4-n and the potentials of all of the scanning electrodes 3-1 through 3-n are held at the scanning base voltage Vbw. That is, the negative-polarity scanning pulse Pwsn (potential: GND) is applied to the scanning electrodes 3-1 through 3-n sequentially and also the positive-polarity data pulses Pd1 through Pdm are applied on the basis of the video signal Sv to the data electrode. The potentials of the data electrodes in the display cells with no display are held at the ground level GND. With this, to write data to a display cell in the a'th row in the b'th column, the negative-polarity scanning pulse Pwsn is applied to the scanning electrode 3-a and, at the same time, the positive-polarity data pulse Pdb is applied to the data electrode 10-b in the b'th column. As a result, opposed discharge occurs at the display cell in the a'th row in the b'th column, to further triggers off surface discharge as write-in discharge between the scanning electrode and the sustaining electrode, so that wall charge sticks to the electrode. In this step, after the priming period Tp, a large amount of positive wall charge is left on the data electrode, so that a sufficient level of write-in discharge occurs even with a lower data voltage Vd than that by the prior art driving method. At the display cells where no write-in discharge occurred, the small amount of wall charge is left as it is after the charge is erased during the priming period Tp. Note here that the wall charge on the scanning or sustaining electrode has been decreased in amount by the application of the priming erasure pulse Ppre1, so that no erroneous discharge (erroneous write-in) occurs.

Also, a difference Dvw1 of the potential (Vs, w=0V) of the scanning pulse Pwsn from a potential (Vd, w=0V) of the data electrode in a display cell to which no write-in operation was performed is given by the following Equation 2:

$$Dvw1=(Vd,\ w)-(Vs,\ w)=0\ (V) \qquad \text{[Equation 2]}$$

Therefore, a relationship of Dvw1>Dvpe1 is established.

Further, a difference between the potential (0V) of the scanning pulse Pwsn and a potential (bias voltage Vsw: 180V) of the bias pulse Pbp is larger than the sustaining voltage Vs (170V).

During the sustaining period Ts following the address period Ta, like by the prior art driving method shown in FIG. 18, the negative-polarity sustaining pulse Psun1 is applied to all of the scanning electrodes 3-1 through 3-n as many times as corresponding to the sub-field and also the negative-polarity sustaining pulse Psun2 is applied to all of the sustaining electrodes 4-1 through 4-n as many times as corresponding to the sub-field exclusively against the sustaining pulse Psun1. With this, a display cell to which no write-in operation was performed during the address period Ta has an extremely small amount of wall charge thereon, so that sustained discharge will not occur even when the sustaining pulse is applied to that display cell, while a display cell where write-in discharge occurred during the address period Ta has positive charge stuck to its scanning electrode and negative charge stuck to its sustaining electrode, so that the sustaining pulse and the wall charge voltage are superimposed on each other to thereby raise the voltage across the electrodes in excess of the discharge start voltage, thus giving rise to discharge.

During the following charge erasure period Te, like by the prior art driving method shown in FIG. 18, the negative-polarity charge erasure pulse Peen is applied to all of the scanning electrodes 3-1 through 3-n. Therefore, weak discharge occurs at all the display cells. With this, the wall charge accumulated on the scanning electrodes and the sustaining electrodes in the display cells which emitted light during the sustaining period Ts is erased, thus unifying the charged state of all the display cells.

By such first embodiment, during the priming period Tp, the priming erasure pulse Ppre1 is applied to the scanning electrode while simultaneously the opposed-discharge preventing pulse Pprs1 is applied to the data electrode, so that during the following address period Ta a large amount of positive wall charge is left as stuck to the data electrode. Therefore, the data voltage Vd can be reduced. Also, by applying the priming erasure pulse Ppre1, the wall voltage of the scanning and sustaining electrodes decreases, thus preventing erroneous write-in operation from occurring during the address period Ta.

Note here that while the priming erasure pulse Ppre1 is applied to the scanning electrode, the potential of the sustaining electrodes may be not less than the sustaining voltage Vs as far as it is not larger than the bias voltage Vsw.

Second Embodiment

Figure 8:
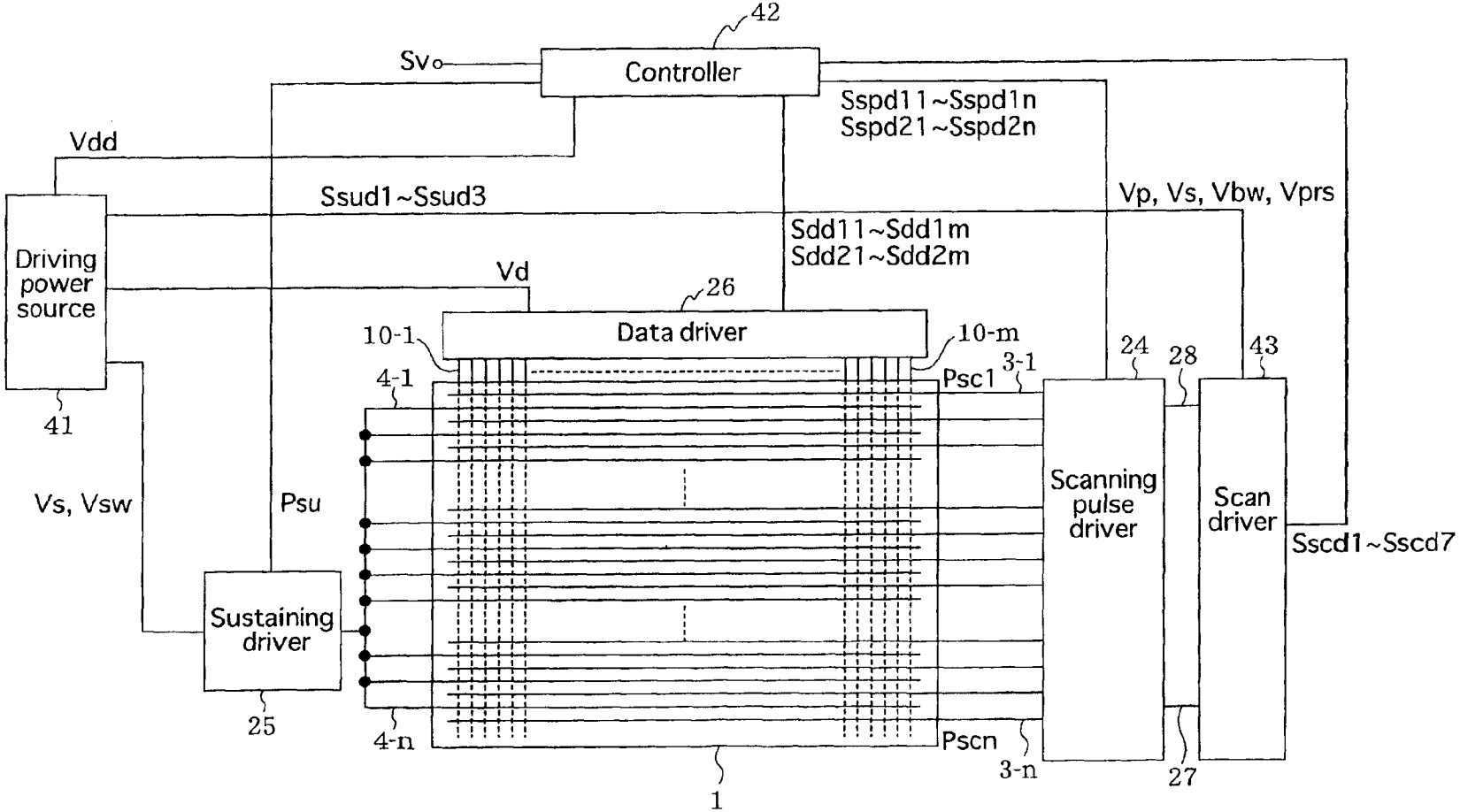
FIG. 8 is a block diagram for showing a construction of the plasma display according to a second embodiment of the present invention.

The following will describe a second embodiment of the present invention. FIG. 8 is a block diagram for showing a construction of the plasma display according to a second embodiment of the present invention.

The second embodiment is different from the first embodiment shown in FIG. 14 in that the driving power source 41 substitutes for the driving power source 31, the controller 42 substitutes for the controller 32, and the scan driver 43 substitutes for the scan driver 23.

The driving power source 41 is configured to generate an opposed-discharge preventing voltage Vprs2 of about 10V besides, for example, the logic voltage Vdd of 5V, the data voltage Vd of about 55V, the sustaining voltage Vs of about 170V, the priming voltage Vp of about 400V, the scanning voltage Vbw of about 100V, and the bias voltage Vsw of about 180V. The opposed-discharge preventing voltage Vprs2 is supplied to the scan driver 43.

The controller 42 consists of a circuit for generating a scan driver control signal Sscd7 besides the scan driver control signals Sscd1–Sscd6, the scanning pulse driver control signals Sspd11–Sspd1n and Sspd2–Sspd2n, the sustaining driver control signals Ssud1–Ssud3, and the data driver control signals Sdd11–Sdd1m and Sdd21–Sdd2m.

Although not shown, the scan driver 43 is configured to output the opposed-discharge preventing voltage Vprs2 via the negative line 28 to the scan pulse driver 24 when the scan driver control signal Sscd7 is turned HIGH.

The driving circuit comprises the driving power source 41, the controller 42, and the drivers 43, 24, 25, and 26.

Figure 9:
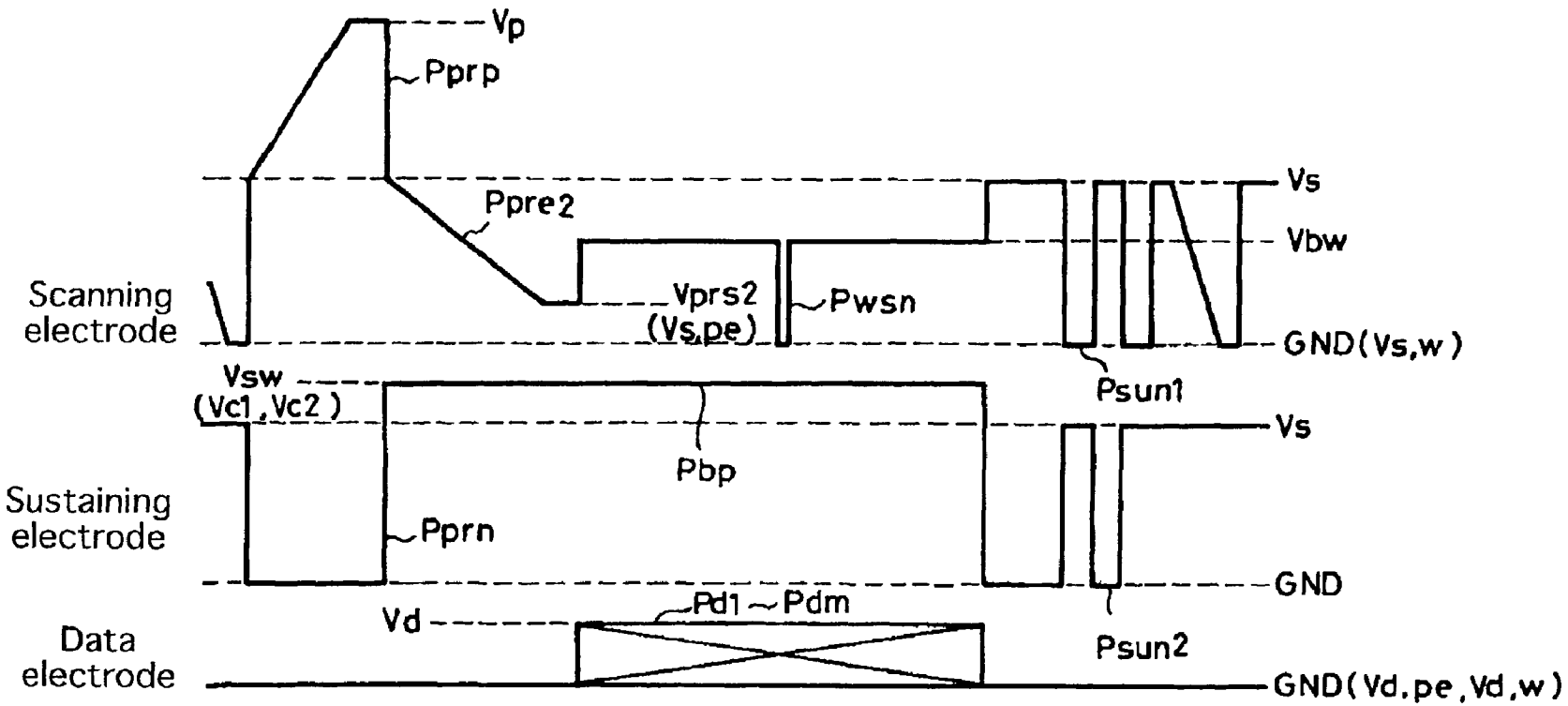
FIG. 9 is a timing chart for showing operations of the plasma display according to the second embodiment of the present invention.

The following will describe the operations of a plasma display according to the second embodiment having the above configuration. FIG. 9 is a timing chart for showing operations of the plasma display according to the second embodiment of the present invention.

In this embodiment, as shown in FIG. 9, like by the driving method according to the first embodiment shown in FIG. 3, during the priming period Tp, in such a state that the data electrodes 10-1 through 10-m are held in potential to the ground level GND, the positive-polarity priming pulse Pprp is applied to the scanning electrodes 3-1 through 3-n and also the negative priming pulse Pprn is applied to the sustaining electrodes 4-1 through 4-n. With this, as shown in FIG. 4, surface discharge occurs between the scanning electrodes 3-1 through 3-n and the sustaining electrodes 4-1 through 4-n, while opposed discharge occurs between the scanning electrodes 3-1 through 3-n and the data electrodes 10-1 through 10-m; as a result, an active particle is generated in the discharge gas space, while at the same time, negative wall charge sticks to all of the scanning electrodes and positive wall charge sticks to all of the data electrodes and all of the sustaining electrodes.

Next, the controller 42 outputs the high-level scan driver control signal Sscd7 to the scan driver 43. The opposed-discharge preventing voltage Vprs2 is, therefore, supplied from the scan driver 43 to the scanning pulse driver 24, so that the priming erasure pulse Ppre2 having the opposed-discharge preventing voltage Vprs2 as its final arrival potential Vs, pe is applied to all of the scanning electrodes 3-1 through 3-n. Simultaneously, the bias pulse Pbp is applied to the sustaining electrodes 4-1 through 4-n to thereby hold their potentials at the bias voltage Vsw (Vc1). The potentials of the data electrodes 10-1 through 10-m stay at the ground level GND. As mentioned above, since the opposed-discharge preventing voltage Vprs2 is 10V, a difference Dvpe of the data electrode's potential (Vd, pe=0V) from the scanning electrode's potential at the moment when the priming erasure pulse Ppre has reached the final arrival potential Vs, pe(=Vprs2) is give by the following Equation 3:

$$Dvpe2=(Vd, pe)-(Vs, pe)=0-10=-10\ (V) \qquad \text{[Equation 3]}$$

Also, a difference between the final arrival potential Vs, pe(10V) and the sustaining electrode's potential (bias voltage Vsw: 180V) is equal to the sustaining voltage Vs (170V).

Therefore, like in the case of the first embodiment, as shown in FIG. 5, opposed discharge will no occur at all between the scanning electrode and the data electrode or, as shown in FIG. 6, may occur extremely faintly. As shown in FIG. 5 or 6, therefore, the wall charge stuck to the scanning electrodes 3-1 through 3-n and the sustaining electrodes 4-1 through 4-n is decreased to such a level in amount that erroneous discharge may not occur during the following address period Ta, while on the data electrodes 10-1 through 10-m, the positive charge stays as unreduced or a relatively large amount of wall charge stays as stuck thereto.

During the following address period Ta, sustaining period Ts, and charge erasure period Te, the same operations as those of the first embodiment are carried out.

During the address period Ta of the second embodiment, therefore, a difference Dvw2 of the potential (Vd, w=0V) of the data electrode in a display cell where no write-in is performed from a potential (Vs, w=0V) of the scanning pulse Pwsn is given by the following Equation 4:

$$Dvw2=(Vd, w)-(Vs, w)=0\ (V) \qquad \text{[Equation 4]}$$

Therefore, a relationship of Dvw2>Dvpe2 is established.

Further, a difference between the potential (0V) of the scanning pulse Pwsn and a potential (bias voltage Vsw: 180V) of the bias pulse Pbp is larger than the sustaining voltage Vs (170) also in the second embodiment.

By the second embodiment, since the final arrival potential Vs, pe of the priming erasure pulse Ppre2 provides the opposed-discharge preventing voltage Vprs2, a large amount of wall charge stays as stuck to the data electrode like in the case of the first embodiment. Therefore, it is possible to generate a sufficient level of write-in discharge even if the data voltage Vd is decreased. Also, the priming erasure pulse Ppre2 is applied, to decrease a wall voltage between the scanning electrode and the sustaining electrode, thus preventing erroneous write-in operations from occurring during the address period Ta. Further, by the second embodiment, a negative voltage need not be generated, thus enabling simplifying the construction of the driving power source 41 as compared to the first embodiment.

Figure 10:
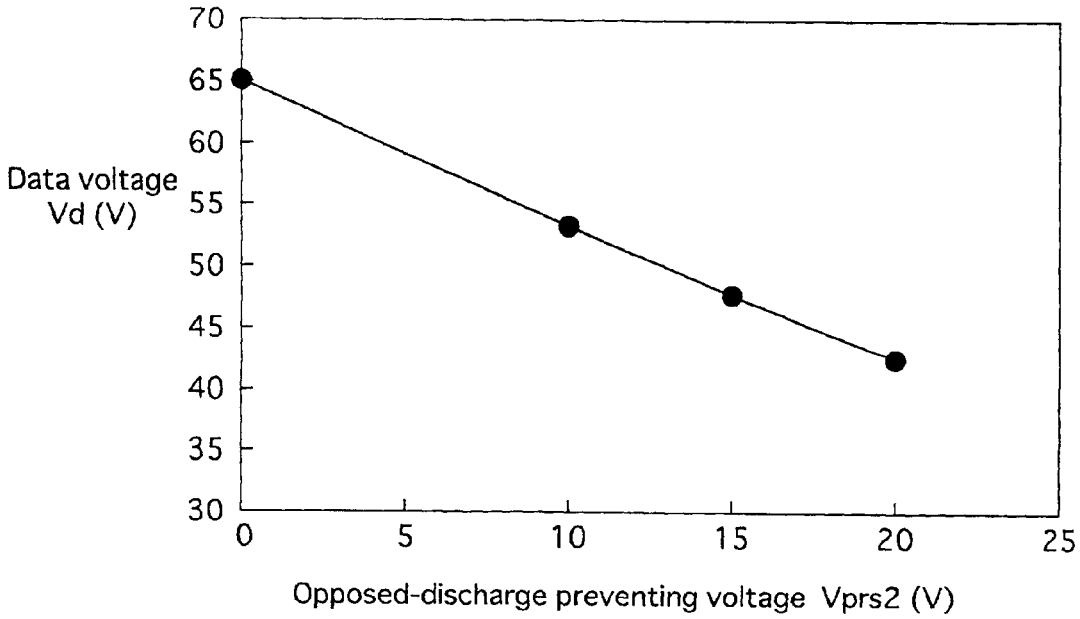
FIG. 10 is a graph for showing a relationship between an opposed-discharge preventing voltage Vprs2 and a required data voltage Vd in the second embodiment.

Note here that while the priming erasure pulse Ppre2 is applied to the scanning electrode, the potential of the sustaining electrode may be not larger than the bias voltage Vsw as far as the potential difference Dvpe2 is less than the potential difference Dvw2 and not less than the sustaining voltage Vs. FIG. 10 is a graph for showing a relationship between an opposed-discharge preventing voltage Vprs2 and a required data voltage Vd in the second embodiment. As shown in FIG. 10, as the opposed-discharge preventing voltage Vprs2 (=Vs, pe) rises, that is, as the potential difference Dvpe2 decreases, the data voltage Vd required in write-in discharge is decreased. That is, the higher the opposed-discharge preventing voltage Vprs2, the more decreases the power consumption.

Figure 11:
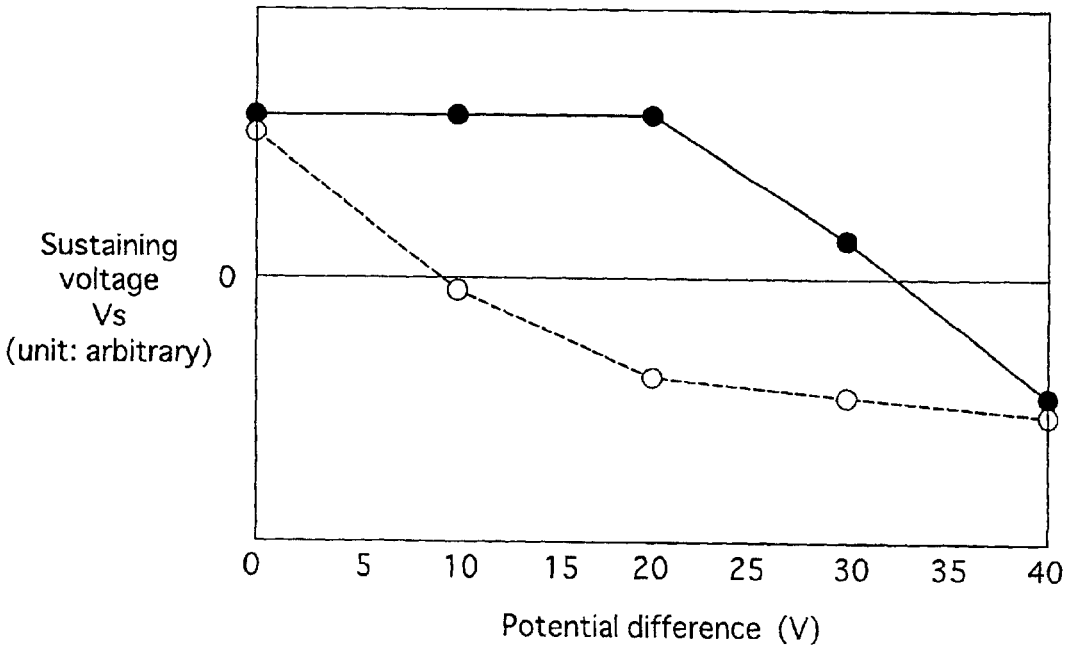
FIG. 11 is a graph for showing a relationship between a sustaining electrode's potential difference and a sustaining voltage Vs in the second embodiment.

Also, although both of the first and second embodiments have provided a value of 0V or 10V as a difference between a potential of the sustaining electrode Vc1 while the priming erasure pulse is applied and a potential of the sustaining electrode Vc2 during the address period Ta, the present invention is not limited thereto. In FIG. 11, a solid line indicates the maximum sustaining voltage Vs at which an erroneous write-in operation does not triggers off erroneous lighting during the sustaining period Ts, while a broken line indicates a minimum sustaining voltage (discharge start voltage) at which erroneous lighting does not occur in the sustaining period. FIG. 11 is a graph for showing a relationship between a sustaining electrode's potential difference and a sustaining voltage Vs in the second embodiment. As shown in FIG. 11, preferably the potential difference of the sustaining electrode is 0–40V, thus enabling reserving the sustaining voltage Vs that does not generate erroneous lighting nor write-in operations. More preferably the potential difference is 15–25V, thus providing a larger driving margin.

Further, the first and second embodiments may be combined to apply the opposed-discharge preventing pulse Pprs1 to the data electrode and also provide the final arrival potential Vs, pe of the priming erasure pulse as the opposed-discharge preventing voltage Vprs2 for the scanning electrode.

Also further, the potential of the data electrode in a display cell where no write-in operations are performed during the address period Ta may be lowered below the ground level GND or the potential of the scanning pulse Pwsn is lowered below the ground level GND so that a difference ((Vd, pe)–(Vs, pe) ) between a potential of the scanning electrode (Vs, pe) and that of the data electrode (Vd, pe), when the priming erasure pulse has reached its final arrival potential, may be smaller than a different ((Vd, w)–(Vs, w) ) between a potential of the scanning pulse (Vs, w) of the scanning pulse and that of the data electrode (Vd, w) in a display cell where write-in operations are not performed.

Figure 12:
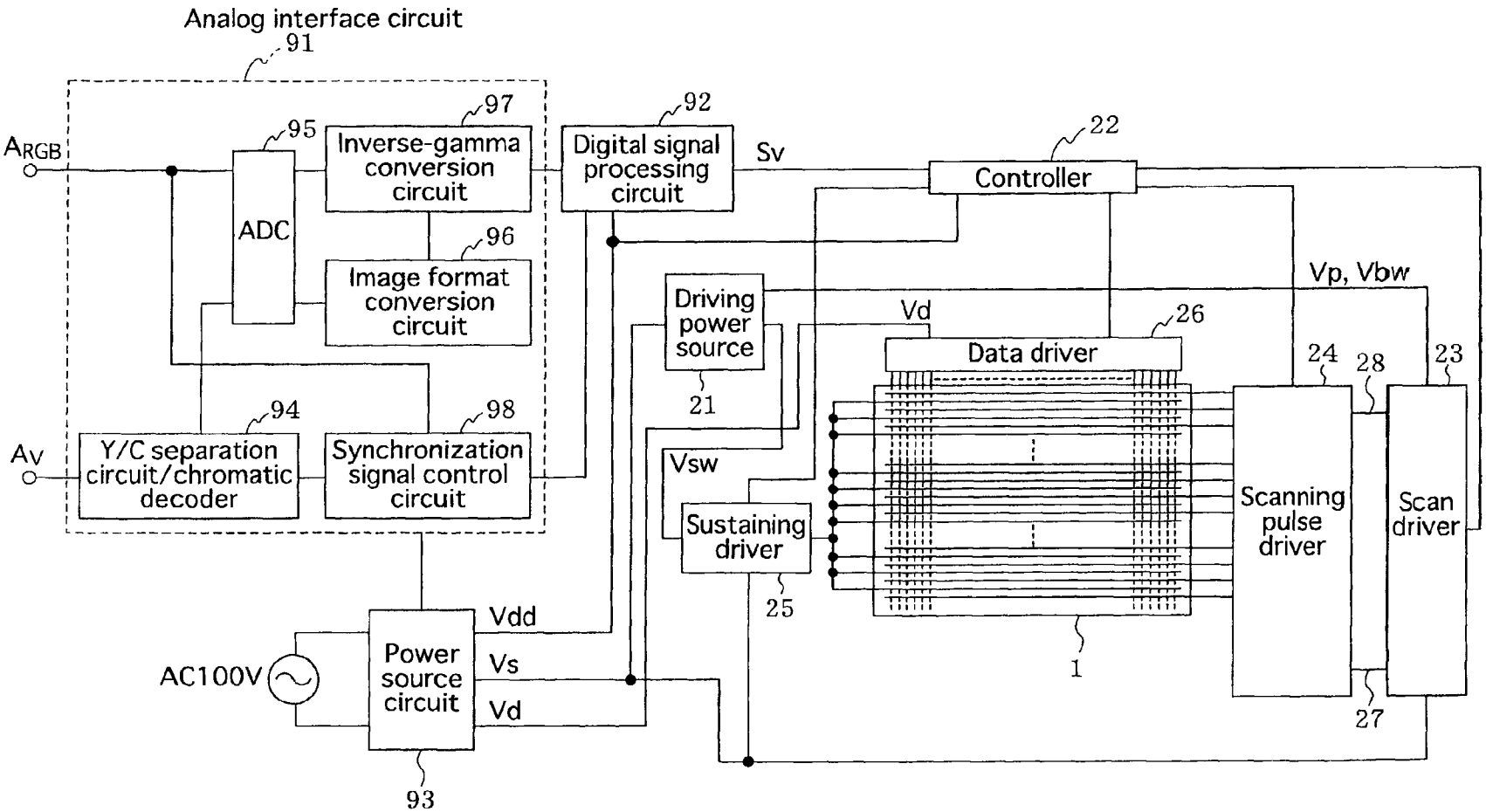
FIG. 12 is a block diagram for showing one example of a display device to which the present invention is applied.
Figure 13:
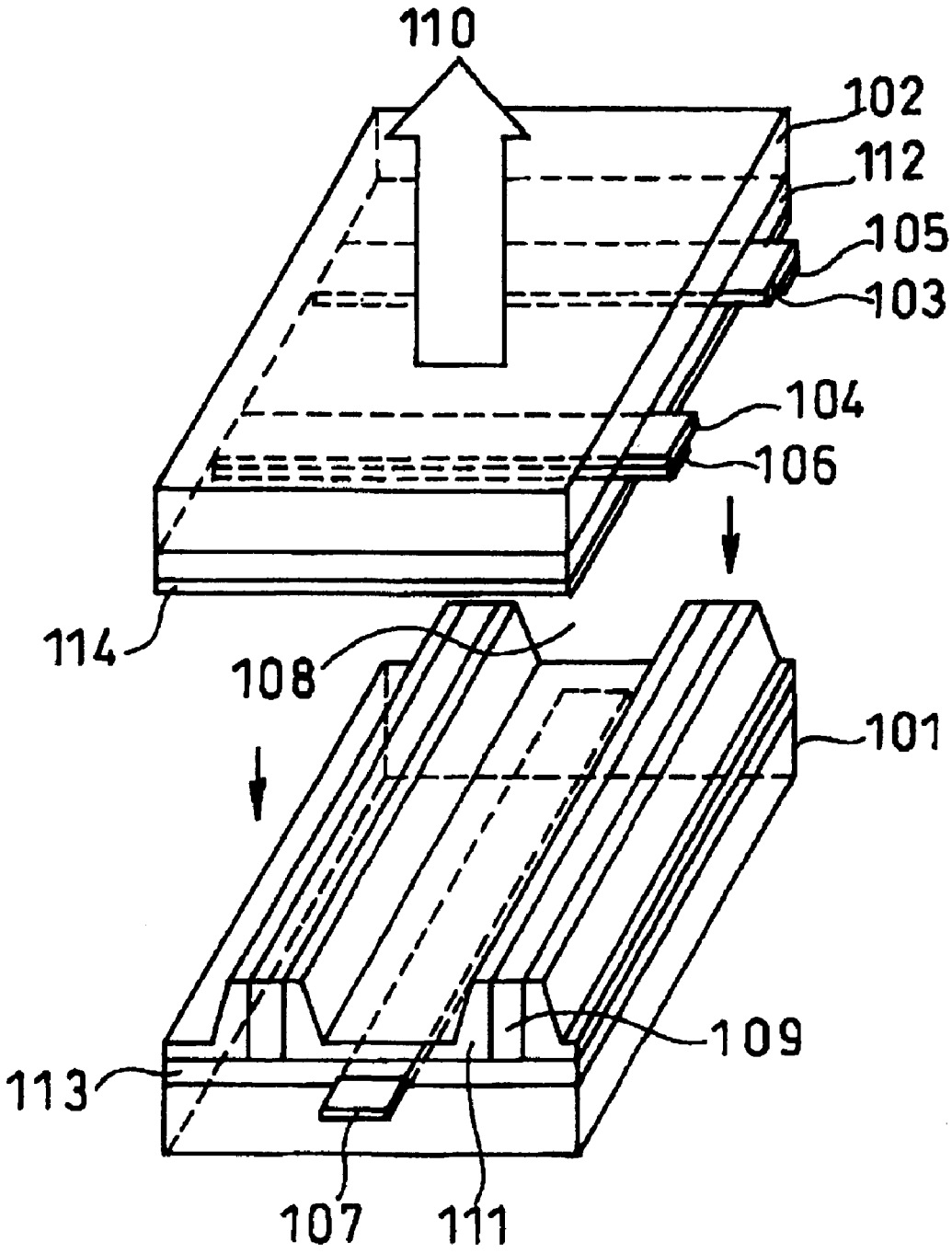
FIG.13 PRIOR ART
FIG. 13 is a perspective view for showing a configuration of one display cell of an AC-type plasma display.

Note here that the plasma display device of the present invention can be used as a TV receiver, a computer monitor, etc. FIG. 12 shows one example of plasma display (PDP multimedia monitor) utilized the present invention. The same elements in FIG. 12 as those of a prior art plasma display shown in FIG. 14 are indicated by the same reference numerals and their detailed description is omitted. This plasma display device comprises the PDP 1 and, at preceding stages of its driving circuit, an analog interface circuit 91 and a digital signal processing circuit 92. Also, a power source circuit 93 is provided for supplying a DC voltage based on 100V AC to each section of the device. The analog interface circuit 91 is comprised of a Y/C separation circuit/chromatic decoder 94, an analog/digital converting circuit (ADC) 95, an image format converting circuit 96, an inverse-gamma conversion circuit 97, and a synchronization signal control circuit 98.

The Y/C separation circuit/chromatic decoder 94 is a circuit for decomposing an analog video signal AV into luminance signals giving read (R), green (G), and blue (B) colors respectively when this display device is used as a TV receiver's display. The ADC 95 is a circuit for, when this display device is used as a computer monitor etc., converting an analog signal $A_{RGB}$ into a digital signal RGB and, when this display device is used as a TV receiver's display, converting the luminance signals for the R, G, and B, colors supplied from the Y/C separation circuit/chromatic decoder 94 into digital luminance signals for the R, G, and B colors. The image format converting circuit 96 is a circuit for, if an picture-element configuration of the PDP 1 mismatches that of the digital luminance signals for the R, G, and B colors, converting the picture-element configuration of each of the digital luminance signals for the R, G, and B colors so that it may match the picture-element configuration of the PDP 1. The inverse-gamma conversion circuit 97 is a circuit for conducting inverse-gamma correction so that the properties of the digital RGB signal gamma-corrected so as to match the gamma properties of the CRT display or of each of the digital luminance signals for the R, G, and B colors sent from the image format converting circuit 96 may match the linear gamma properties of the PDP1. The synchronization signal control circuit 98 is a circuit for generating a sampling clock signal and a data clock signal based on a horizontal synchronization signal supplied together with the analog video signal AV.

In the prior art plasma display shown in FIG. 14, the logic voltage Vdd, the data voltage Vd, and the sustaining voltage Vs are generate by the driving power source 21, while the priming voltage Vp etc are generated by the driving power source 21 based on the sustaining voltage Vs. In the plasma display device shown in FIG. 12, on the other hand, the power source circuit 93 generates the logic voltage Vdd, the data voltage Vd and the sustaining voltage Vs from 100V AC, while the power source 21 generates the priming voltage Vp etc. based on the sustaining voltage Vs supplied from the power source circuit 93 in configuration. Also, such sections are all given in a module as the PDP1, the controller 22, the driving power source 21, the scan driver 22, the scanning pulse driver 24, the sustaining driver 25, the data driver 26, and the digital signal processing circuit 92. Such a plasma display device can be applied to both the first and second embodiments.

Thus, by the present invention, at the time of priming erasure, opposed discharge does not occur at all or, if any, may occur only faintly, so that the positive wall charge previously given on the data electrode can be left almost unreduced, thus contributing to an improvement in the internal voltage for the following write-in operations. Therefore, a sufficient write-in operation can be performed even if the potential of the data pulse applied to the data electrode is reduced, thus decreasing the power consumption. Also, as for the potential of the sustaining electrode, the potential Vc1 at the time of priming erasure is set not larger than the potential Vc2 at the time of write-in operations, thus enabling suppressing the occurrence of erroneous lighting due to erroneous write-in operations. Further, a relationship of $Vs \leqq Vc2-(Vs, w) < Vs + 40(V)$ can be established, thus effectively generating a sufficient level of write-in discharge and preventing erroneous lighting from occurring.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and rage of equivalency of the claims are therefore intended to be embraced therein.

The entire disclosure of Japanese Patent Application No. 2001-053805 (Filed on Feb. 28, 2001) including specification, claims, drawings and summary are incorporated herein by reference in its entirety

What is claimed is:

1. A method for driving a plasma display panel that includes; first and second substrates disposed opposite to each other, a plurality of scanning electrodes and a plurality of sustaining electrodes which extend in a first direction and are alternately disposed on such a side surface of said first substrate that faces said second substrates, and a plurality of data electrodes which extends in a second direction perpendicular to said first direction and is disposed on such a side surface of said second substrate that faces said first substrate, in such a configuration that a display cell is disposed at each of intersections between said scanning and sustaining electrodes and said data electrodes, to produce a display which corresponds to a video signal, said method comprising the steps of:

giving negative wall charge on said scanning electrodes and positive wall charge on said sustaining electrodes and said data electrodes;

adjusting an amount of the negative wall charge on said scanning electrodes, an amount of the positive wall charge on said sustaining electrodes, and an amount of the positive wall charge on said data electrodes;

setting a potential of said scanning electrodes to a positive constant value; and sequentially applying to said scanning electrodes a scanning pulse having a voltage lower than said constant value and also applying a rising data pulse to said data electrodes based on said video signal, to thereby generate write-in discharge selectively, wherein relationships of:

$$(Vd, pe)-(Vs, pe)<(Vd, w)-(Vs, w); \text{ and}$$

$$Vc1 \leqq Vc2$$

are established, where (Vs, pe) indicates a final arrival potential of said scanning electrodes in said wall-charge amount adjusting step, Vc1 indicates a potential of said sustaining electrodes, (Vd, pe) indicates a potential of said data electrodes, (Vs, w) indicates a potential of said scanning pulse, (Vd, w) indicates a potential of said data electrode in the display cell to which said data pulse is not applied even when said scanning pulse is applied on the basis of said video signal, and Vc2 indicates a potential of said sustaining electrodes in said step of applying said scanning pulse and said data pulse.

2. The plasma display panel driving method according to claim 1, further comprising a step of applying a sustaining pulse with a potential of Vs to said scanning and sustaining electrodes alternately after said step of generating the write-in discharge, wherein a relationship of:

$$Vs \leqq Vc2-(Vs, w)<Vs+40(V)$$

is established.

3. The plasma display panel driving method according to claim 1, wherein a relationship of:

$$(Vs, pe)>(Vs, w)$$

is established.

4. The plasma display panel driving method according to claim 3, wherein a relationship of:

$$Vc1-(Vs,pe)<Vc2-(Vs,w)$$

is established.

5. The plasma display panel driving method according to claim 1, wherein a relationship of:

$$(Vd, pe)<(Vd, w)$$

is established.

6. The plasma display panel driving method according to claim 5, wherein a relationship of:

$$Vc1-(Vs, pe) \leqq Vc2-(Vs, w)$$

is established.

7. The plasma display panel driving method according to claim 2, wherein a relationship of:

$$Vc1-(Vs, pe) \geqq Vs$$

is established.

8. A plasma display panel driving circuit that includes; first and second substrates disposed opposite to each other, a plurality of scanning electrodes and a plurality of sustaining electrodes which extend in a first direction and are alternately disposed on such a side surface of said first substrate that faces said second substrates, and a plurality of data electrodes which extends in a second direction perpendicular to said first direction and is disposed on such a side surface of said second substrate that faces said first substrate, in such a configuration that a display cell is disposed at each of intersections between said scanning and sustaining electrodes and said data electrodes, said circuit comprising a controller operable:

to give negative wall charge on said scanning electrodes and positive wall charge on said sustaining electrodes and said data electrodes;

to adjust an amount of the negative wall charge on said scanning electrodes, an amount of the positive wall charge on said sustaining electrodes, and an amount of the positive wall charge on said data electrodes;

to set a potential of said scanning electrodes to a positive constant value; and to sequentially apply to said scanning electrodes a scanning pulse having a voltage lower than said constant value and also applying a rising data pulse to said data electrodes based on said video signal, to thereby generate write-in discharge selectively, wherein relationships of:

$$(Vd, pe)-(Vs, pe)<(Vd, w)-(Vs, w); \text{ and}$$

$$Vc1 \leqq Vc2$$

are established, where (Vs, pe) indicates a final arrival potential of said scanning electrodes in said wall-charge amount adjusting step, Vc1 indicates a potential of said sustaining electrodes, (Vd, pe) indicates a potential of said data electrodes, (Vs, w) indicates a potential of said scanning pulse, (Vd, w) indicates a potential of said data electrode in the display cell to which said data pulse is not applied even when said scanning pulse is applied on the basis of said video signal, and Vc2 indicates a potential of said sustaining electrodes in said step of applying said scanning pulse and said data pulse.

9. The plasma display panel driving circuit according to claim 8, wherein:

said controller can generate a control signal for applying, after the write-in discharge is generated, the sustaining pulse with a potential of Vs to said scanning and sustaining electrodes alternately for emitting of light for display; and a relationship of:

$$Vs \leqq Vc2-(Vs, w)<Vs+40(V)$$

is established.

10. The plasma display panel driving circuit according to claim 8, wherein a relationship of:

$$(Vs, pe)>(Vs, w)$$

is established.

11. The plasma display panel driving circuit according to claim 10, wherein a relationship of:

$$Vc1-(Vs, pe)<Vc2-(Vs, w)$$

is established.

12. The plasma display panel driving circuit according to claim 8, wherein a relationship of:

$$(Vd, pe)<(Vd, w)$$

is established.

13. The plasma display panel driving circuit according to claim 12, wherein a relationship of:

$$Vc\mathbf{1}-(Vs, pw)\leqq Vc\mathbf{2}-(Vs, w)$$

is established.

14. The plasma display panel driving circuit according to claim 9, wherein a relationship of:

$$Vc\mathbf{1}-(Vs\ pe)\geqq Vs$$

is established.

15. A plasma display device comprising:

a plasma display panel driving circuit that includes; first and second substrates disposed opposite to each other, a plurality of scanning electrodes and a plurality of sustaining electrodes which extend in a first direction and are alternately disposed on such a side surface of said first substrate that faces said second substrates, and a plurality of data electrodes which extends in a second direction perpendicular to said first direction and is disposed on such a side surface of said second substrate that faces said first substrate, in such a configuration that a display cell is disposed at each of intersections between said scanning and sustaining electrodes and said data electrodes, said circuit comprising a controller operable:

to give negative wall charge on said scanning electrodes and positive wall charge on said sustaining electrodes and said data electrodes;

to adjust an amount of the negative wall charge on said scanning electrodes, an amount of the positive wall charge on said sustaining electrodes, and an amount of the positive wall charge on said data electrodes;

to set a potential of said scanning electrodes to a positive constant value; and to sequentially apply to said scanning electrodes a scanning pulse having a voltage lower than said constant value and also applying a rising data pulse to said data electrodes based on said video signal, to thereby generate write-in discharge selectively, wherein relationships of:

$$(Vd, pe)-(Vs, pe)<(Vd, w)-(Vs, w);\ \text{and}$$

$$Vc\mathbf{1}\leqq Vc\mathbf{2}$$

are established, where (Vs, pe) indicates a final arrival potential of said scanning electrodes in said wall-charge amount adjusting step, Vc1 indicates a potential of said sustaining electrodes, (Vd, pe) indicates a potential of said data electrodes, (Vs, w) indicates a potential of said scanning pulse, (Vd, w) indicates a potential of said data electrode in the display cell to which said data pulse is not applied even when said scanning pulse is applied on the basis of said video signal, and Vc2 indicates a potential of said sustaining electrodes in said step of applying said scanning pulse and said data pulse; and a plasma display driven by said driving circuit.

* * * * *